US009781521B2

(12) United States Patent
Kofod-Hansen et al.

(10) Patent No.: US 9,781,521 B2
(45) Date of Patent: Oct. 3, 2017

(54) HEARING ASSISTANCE DEVICE WITH A LOW-POWER MODE

(71) Applicants: Oticon A/S, Smørum (DK); Bernafon AG, Berne (CH)

(72) Inventors: Andreas Kofod-Hansen, Smørum (DK); Svend Oscar Petersen, Smørum (DK); Gabriel Aldaz, Smørum (DK); Gunnar Gudnason, Smørum (DK); Michael Syskind Pedersen, Smørum (DK); Dennis Presutti, Smørum (DK); Björn Legler, Smørum (DK); Poul Hilding Andersson, Smørum (DK); Christian Müller, Berne (DK); Jesko Lamm, Berne (CH); Monika Bertges Reber, Berne (CH)

(73) Assignees: OTICON A/S, Smorum (DK); BERNAFON AG, Berne (CH)

( * ) Notice: Subject to any disclaimer, the term of this patent is extended or adjusted under 35 U.S.C. 154(b) by 901 days.

(21) Appl. No.: 13/869,661

(22) Filed: Apr. 24, 2013

(65) Prior Publication Data

US 2014/0321682 A1 Oct. 30, 2014

(51) Int. Cl.
*H04R 25/00* (2006.01)

(52) U.S. Cl.
CPC ..... *H04R 25/30* (2013.01); *H04R 25/305* (2013.01); *H04R 25/552* (2013.01); *H04R 2225/55* (2013.01); *H04R 2460/03* (2013.01)

(58) Field of Classification Search
CPC ..... H04R 25/554; H04R 2460/03; H04R 25/558; H04R 25/552; H04R 2225/61;
(Continued)

(56) References Cited

U.S. PATENT DOCUMENTS 4,955,729 A 9/1990 Marx
5,144,678 A 9/1992 Lenz
(Continued)

FOREIGN PATENT DOCUMENTS

DE 40 34 096 A1 1/1992
DE 10 2008 054 087 A1 12/2009
(Continued)

*Primary Examiner* — Davetta W Goins
*Assistant Examiner* — Phylesha Dabney
(74) *Attorney, Agent, or Firm* — Birch, Stewart, Kolasch & Birch, LLP

(57) ABSTRACT

A portable hearing assistance device comprises an input unit, an output unit, a forward path between the input unit and the output unit, and an energy source for energizing components of the hearing assistance device. The hearing assistance device further comprises a control unit to control activation (or deactivation) of a low-power mode of operation of the hearing assistance device. When the low-power mode is activated—the draw of current from said energy source is reduced compared to a normal mode of operation of the device, the activation (or deactivation) being influenced by a combination of at least two different control input signals to the control unit, each control input signal being a signal selected from 1) signals relating to current physical environment, 2) signals relating to current acoustic environment, 3) signals relating to current wearer state, and 4) signals relating to current state or operation mode.

24 Claims, 8 Drawing Sheets

(58) Field of Classification Search

CPC .... H04R 25/00; H04R 25/43; H04R 2225/31; H04R 2225/51; H04R 2420/07; H04R 2460/13; H04R 25/407; H04R 25/505; H04R 27/00; H04R 27/02; H04R 29/007; H04R 2225/023; H04R 2225/41; H04R 2225/55; H04R 25/50; H04R 25/606; H04R 1/028; H04R 1/1025; H04R 1/46; H04R 2201/003; H04R 2225/021; H04R 2225/025; H04R 2225/33; H04R 2225/39; H04R 2225/04; H04R 25/305; H04R 25/30

USPC ..... 381/312, 313, 315, 323, 328; 455/234.1, 455/343.2

See application file for complete search history.

(56) References Cited

U.S. PATENT DOCUMENTS

| | | | | |
|---|---|---|---|---|
| 6,330,339 | B1 * | 12/2001 | Ishige | H04R 25/502 381/312 |
| 6,532,294 | B1 | 3/2003 | Rudell | |
| 6,704,428 | B1 | 3/2004 | Wurtz | |
| 6,711,271 | B2 * | 3/2004 | Hou | H04R 25/00 381/312 |
| 7,010,332 | B1 | 3/2006 | Irvin et al. | |
| 7,522,739 | B2 | 4/2009 | Rass et al. | |
| 8,923,789 | B2 * | 12/2014 | Bendsen | H03F 1/56 455/193.1 |
| 2002/0186857 | A1 | 12/2002 | Bren et al. | |
| 2004/0252855 | A1 | 12/2004 | Vasserman et al. | |
| 2005/0226446 | A1 | 10/2005 | Luo et al. | |
| 2006/0029234 | A1 | 2/2006 | Sargaison | |
| 2006/0233413 | A1 | 10/2006 | Nam | |
| 2007/0253584 | A1 | 11/2007 | Rass | |
| 2008/0080705 | A1 | 4/2008 | Gerhardt et al. | |
| 2009/0087005 | A1 | 4/2009 | Reithinger | |
| 2014/0056452 | A1 | 2/2014 | Moss et al. | |
| 2015/0304783 | A1 * | 10/2015 | Haubrich | H04R 25/554 381/315 |

FOREIGN PATENT DOCUMENTS

| | | |
|---|---|---|
| EP | 0 674 466 A1 | 9/1995 |
| EP | 1 465 454 A2 | 10/2004 |
| EP | 1 871 140 B1 | 12/2007 |
| EP | 2 071 873 A1 | 6/2009 |
| EP | 2 211 579 A1 | 7/2010 |
| GB | 1 254 017 | 11/1971 |

* cited by examiner

| ID1 | ID2 | ID3 | ID4 | BATC | Comment |
|---|---|---|---|---|---|
| MOVE | VOICE | T≥35°C | FB≥$X_{th}$ | **NORM** | Maybe FB-situation (hug, hat, hand) |
| STILL | NO VOICE | T<35°C | FB<$X_{th}$ | **LP** | LD put off, not on reflecting surface |
| MOVE | VOICE | T≥35°C | FB<$X_{th}$ | **NORM** | Normal operational situation |
| STILL | NO VOICE | T<35°C | FB≥$X_{th}$ | **LP** | LD located on/near reflecting surface |
| MOVE | NO VOICE | T<35°C | FB≥$X_{th}$ | **LP** | LD maybe put off, but held in hand |
| STILL | VOICE | T≥35°C | FB<$X_{th}$ | **NORM** | Normal OP in still environment |
| MOVE | VOICE | T<35°C | FB<$X_{th}$ | **NORM** | Maybe normal OP in cold environment |
| STILL | NO VOICE | T≥35°C | FB≥$X_{th}$ | **LP** | Maybe put off in warm location |
| MOVE | VOICE | T<35°C | FB≥$X_{th}$ | **NORM** | Maybe FB-situation in cold environment |
| STILL | NO VOICE | T≥35°C | FB<$X_{th}$ | **NORM** | Normal OP in quiet environment |
| MOVE | NO VOICE | T≥35°C | FB≥$X_{th}$ | **NORM** | Maybe quiet FB-situation (hat, hug) |
| STILL | VOICE | T<35°C | FB<$X_{th}$ | **NORM** | Maybe still OP in cold environment |
| MOVE | NO VOICE | T≥35°C | FB<$X_{th}$ | **NORM** | Normal OP in quiet environment |
| MOVE | NO VOICE | T<35°C | FB<$X_{th}$ | **NORM** | Maybe OP in quiet, cold environment |
| STILL | VOICE | T≥35°C | FB≥$X_{th}$ | **NORM** | Maybe FB-situation (hug, hat, hand) |
| STILL | VOICE | T<35°C | FB≥$X_{th}$ | **LP** | LD put off in voice environment |

FIG. 1b

HEARING ASSISTANCE DEVICE WITH A LOW-POWER MODE

TECHNICAL FIELD

The present application relates to portable hearing assistance devices, e.g. hearing aids, having a limited source of energy (e.g. a battery). The disclosure relates specifically to the conditions for entering or leaving a low-power mode in a hearing assistance device.

The application furthermore relates to a method of providing a low-power mode in a hearing assistance device. The application further relates to a data processing system comprising a processor and program code means for causing the processor to perform at least some of the steps of the method.

Embodiments of the disclosure may e.g. be useful in applications such as hearing aids, headsets, ear phones, active ear protection systems, etc., or combinations thereof.

BACKGROUND

The following account of the prior art relates to one of the areas of application of the present application, hearing aids (including headsets).

The battery power in a hearing aid lasts as little as 3 days for a conventional Zinc-air battery and as little as 6 hours for a rechargeable solution (depending on the battery size and the power consumption of the hearing aid). In order to make the battery power last as long as possible, the user should turn off the hearing aid when it is not in use, i.e. when it is not placed in or at the ear. This is today done by either opening the battery drawer, or by operating a switch on the hearing aid.

To open the battery drawer for powering off can be a problematic issue for users with reduced dexterity. In hospitals and nursing homes, care personnel often have to switch off hearing instruments that have been taken off but not powered down by their owner.

An additional switch, used for powering off, takes up space in hearing aids that in many cases are designed to be as small as possible.

There are two reasons why the hearing instruments should be powered off:

1) When hearing instruments are powered on while not used, the battery lifetime is reduced unnecessarily.

2) When hearing instruments are powered on while not used, they may annoy other people in the environment with a feedback sound that often occurs when a hearing instrument is turned on, but not worn.

The automatic provision of a power off mode in a hearing aid or other hearing assistance device (with the aim of automatically powering the hearing instrument off, when it is not worn) is thus attractive and has been dealt with in a number of prior art documents, some of which are identified in the following.

U.S. Pat. No. 4,955,729 discloses the use of a sensor for deciding whether or not a hearing aid should be switched on or off. The hearing aid includes an electronic amplifier, an electric power source and a switch for automatically breaking or making the connection between the amplifier and the power source depending on whether the hearing aid is in use or out of use. The switch is provided in such a manner so as to be responsive to a switching criterion defined by a change of state such as change in temperature, moisture etc. Sensors for measuring change of temperature, moisture, light, posture, oxygen partial pressure, motion, feedback (the latter identifying a signal generated through acoustic feedback between microphone and earphone after removing the hearing aid) are mentioned.

US 2005/0226446 A1 deals with a hearing aid that is capable of automatically switching between a full-function mode and a sleep mode depending on the location of the hearing aid. The hearing aid comprises a location sensor module for providing a location information signal to indicate one of an in-the-ear case and an out-of-the-ear case. Location information is based on using the surface reflection of IR light (e.g. 600-800 nm) by human skin to switch between a full function mode and a sleep mode of a hearing aid.

U.S. Pat. No. 7,522,739 deals with the switching on and off of a hearing aid using a temperature sensor, a pressure sensor, or a resistance sensor to detect an electrical load resistance as a function of volume or an acoustic sensor to detect a sound level.

U.S. Pat. No. 6,532,294 discloses the use of a temperature sensor or a contact sensor for detecting whether or not a hearing aid should be switched on or off.

EP 0 674 466 A1 discloses the use of an acoustic sensor, a temperature sensor, a photo detector, a force sensor, or a resistance sensor for detecting whether or not a hearing aid should be switched on or off.

EP 1 465 454 A2 describes detecting removal of a hearing aid from the ear canal by measuring the receiver signal "reflected" from the ear canal.

US 2009/087005 A1 describes a pair of wirelessly connected hearing aids that are automatically switched on and off based on a field strength or value of an electromagnetic signal received by a hearing aid that is transmitted from the respective other hearing aid.

DE 10 2008 054087 A1 describes a hearing aid comprising a capacitive proximity sensor comprising two metallic electrodes. The proximity sensor is designed, such that the hearing aid is switched off when the hearing aid is not worn at a head. The electrodes are formed by structuring an inner side of the housing.

EP 2 071 873 A1 decides whether a hearing aid is worn or not, by actively sending out a measurement signal and comparing the measured properties of the acoustic path transfer function (feedback) with reference data (stored in a memory) collected while the hearing was being worn under normal conditions. Whenever this comparison shows significant (predefined) differences, it is automatically concluded that the hearing aid is currently not being worn and an automatic power-off to conserve the battery is triggered.

U.S. Pat. No. 5,144,678 describes a headset with an on/off switch, which can turn itself on or off depending on whether or not it is placed on the head of a user.

U.S. Pat. No. 7,010,332 describes a wireless headset with automatic on/off-function. Various (general) sensors are mentioned, incl. proximity-sensors.

US 2006/0029234 A1 describes a 'headphone device' comprising a system for detecting whether or not it is in use, with the aim of identifying the 'state' of the device. A temperature-sensor and a skin-resistance-sensor are specifically mentioned.

US 2006/0233413 A1 describes the use of a capacitance sensor in an 'ear-phone'-system for on/off-control.

US 2008/0080705 A1 describes a headset comprising means for detecting whether or not it is mounted on the head of a user. The use of an IR-sensor for this purpose is mentioned.

U.S. Pat. No. 6,704,428 describes detecting removal of a headset when noise generated by blood-flow or jaw-movement in the user's head disappears.

DE 4034096 discloses detecting non-use of a mobile device (e.g. a hearing aid) by means of a motion sensor. The mobile device (or at least one stage of such device) is switched ON and/or OFF in dependence on movement or a movement change as detected by a movement responding sensor.

EP 2 211 579 A1 discloses a portable communication system comprising first and second communication devices, the system being adapted to detect when the two communication devices are located closer to each other or farther from each other than a range indicating a normal distance of operation and corresponding to a VeryClose and a VeryFar zone, respectively, and to use the dynamic transmit power regulation to implement a partial power-down mode of the system, when the two communication devices are located in said VeryClose or in said VeryFar zone.

EP 2 071 873 A1 mentions the possibility of putting a hearing instrument in a low power mode, based on monitoring the acoustic feedback path by means of a waveform and a matched filter that is adapted to it.

EP 1 871 140 B1 describes the use of a hearing aid comprising a coil and a current measurement unit configured to measure a current in the coil and an external resonance circuit (e.g. located in a storage box) allowing the measurement unit to measure a change in current when the hearing aid is located in the vicinity of the resonance circuit, and to perform an action based thereon, e.g. to power the hearing aid off. The use of a magnetic switch in a hearing aid and an external magnet in a storage box for the same use (power down) is also mentioned.

GB 1254017 A describes a reed relay switch inside a hearing aid which is operable by a magnet outside the casing to switch the hearing aid on and off. At night the hearing aid is placed in a case and a permanent magnet opens the reed relay switch to disconnect the accumulator from the amplifier.

US 2007/253584 A1 describes a binaural hearing aid system comprising first and second hearing devices. The first and second hearing device each comprise a permanent magnet and a magnetic field sensor such that they can be switched off, when the first and second hearing devices are located in close physical proximity to each other.

Some of these schemes have the disadvantage that the measurement used to decide whether the device is worn or not has the potential to disturb the user of the device or other people.

Most of the prior art solutions rely on a single measurement (or on the value of a single parameter) and may at times lead to erroneous conclusions due to unforeseen situations. A forced power-down at an unintended point in time may of course be highly frustrating for a user.

SUMMARY

An object of the present application is to provide an improved concept for switching a hearing assistance device to or from a low-power mode. In an embodiment, an object of the application is to reduce the risk of performing power-down action that is un-intended by a user.

Objects of the application are achieved by the invention described in the accompanying claims and as described in the following.

A Hearing Assistance Device:

In an aspect an object of the application is achieved by a portable hearing assistance device comprising

- an input unit for providing an electric input signal comprising an audio signal,
- an output unit for providing on output signal originating from the audio signal,
- a forward path between the input unit and the output unit,
- an energy source for energizing components of the hearing assistance device.

The hearing assistance device further comprises a control unit configured to control the activation of a low-power mode of operation of the hearing assistance device, wherein—when said low-power mode is activated—the draw of current from said energy source is reduced compared to a normal mode of operation of the device, the activation being influenced by a combination of at least two different control input signals to the control unit, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device.

In an aspect, a portable hearing assistance device is provided, the portable hearing assistance device comprising

- an input unit for providing an electric input signal comprising an audio signal,
- an output unit for providing on output signal originating from the audio signal,
- a forward path between the input unit and the output unit,
- an energy source for energizing components of the hearing assistance device,
- a control unit configured to control the activation and deactivation of a low-power mode of operation of the hearing assistance device, wherein—when said low-power mode is activated—the draw of current from said energy source is reduced compared to a normal mode of operation of the device, wherein the number of control input signals used by the control unit to decide on a deactivation of the low-power mode is smaller than the number of control input signals used to activate the low-power mode.

In an embodiment, the control unit is configured to control the deactivation of the low-power mode by a single control input signal from a movement sensor.

This has the advantage of improving functionality of the hearing assistance device. It is an aim of the device and method of the present disclosure to increase the reliability of the action of activating or deactivating a low-power mode of the hearing assistance device, by including information from several sources in each decision to enter or leave a low-power mode. Preferably, the at least two control input signals complement each other to thereby improve the basis for deciding whether or not the hearing assistance device is intended to enter or leave a low-power mode. In preferred embodiments, the control unit comprises a multitude of control inputs and is configured to dynamically select the most relevant of the control input signals to influence the decision on activation or deactivation of a low-power mode depending on a classification of the current situation.

The term 'the draw of current from said energy source is reduced compared to a normal mode operation' is in the present context taken to mean that the draw of current is significantly reduced, such as reduced to less than 50% of a draw of current of a normal mode, e.g. less than 25%, such as less than 10%, ultimately less than 1%. In an embodiment, the draw of current of a normal mode is in the range from 1 mA to 5 mA. In an embodiment 'a reduced draw of current' in a low-power mode is smaller than 0.5 A, such as smaller than 100 μA, such as smaller than 20 μA. In a particular embodiment, the low-power mode includes a total power down mode of the hearing assistance device, wherein the (intended) draw of current from the energy source is reduced to zero (or reduced to the absolute minimum). In an alternative embodiment, the total power down mode is a distinct mode, different from the low-power mode.

In the present context, the term 'deactivation of the low-power mode' is generally taken to imply an activation of a normal mode of operation of the hearing assistance device wherein the draw of current from the energy source is increased.

In an embodiment, a deactivation of the low-power mode (i.e. a power-on of the hearing assistance device) is also controlled by the control unit. In an embodiment, a deactivation of the low-power mode is based on the same control input signals as the activation. In an embodiment, at least one of the control input signals to the control unit for deciding on a deactivation of the low-power mode is different from the control input signals used to decide on an activation of the low-power mode. In an embodiment, the number of control input signals used by the control unit to decide on a deactivation of the low-power mode is smaller than the number of control input signals used to activate the low-power mode. In an embodiment, only one control input signal is used by the control unit to decide on a deactivation of the low-power mode. In an embodiment, this only control input signal is a movement detection signal.

In an embodiment, the control unit is configured to delay the deactivation of (i.e. stay in) the low-power mode with a predefined time period after a condition for leaving the low-power mode has been fulfilled (e.g. in that a movement of the hearing assistance device has been detected). In an embodiment, the predefined time period is longer than 2 s, such as longer than 5 s, such as longer than 10 s, such as longer than 30 s, such as 100 s or more. In an embodiment, the control unit is configured to activate the detectors that provide the at least two control input signals when a condition for leaving the low-power mode has been fulfilled and to return to the low-power mode, if—based on the at least two control input signals—a condition for entering the low power mode is fulfilled. Thereby the risk of unintentionally powering ON the hearing assistance device is reduced.

In an embodiment, one or more additional sensors providing one or more additional control input signals (which in a low-power mode is/are initially deactivated) is/are activated (i.e. provided with sufficient power to function) when a first control input signal indicates that a deactivation of the low-power mode should be initiated. Preferably, the actual decision is postponed until one or more of said additional control signals are available (as inputs to the control unit).

In an embodiment, the hearing assistance device comprises a user operable activation element (e.g. a button of a remote control) configured to allow deactivation of the low-power mode. In an embodiment, the user operable activation element is the only means of deactivation of the low-power mode. In an embodiment, the control unit is configured to provide that the activation element overrides an automatic decision to activate the low-power mode. In an embodiment, an automatic decision by the control unit to enter the low-power mode is disabled for a predefined time (e.g. for 1 hour or more) after an operation of the manual activation element to deactivate (i.e. leave) the low-power mode has been performed.

Preferably, the hearing assistance device comprises two or more detectors configured to provide the at least two different control input signals to the control unit.

Preferably, a specific control input signal to the control unit is provided by a detector output signal from a specific detector.

In an embodiment, the hearing assistance device comprises a user interface, e.g. in the form of a remote control device, e.g. a separate device or integrated with a portable telephone apparatus, e.g. a Smartphone. In an embodiment, the hearing assistance device is adapted to allow a user to add a particular external sensor to the control input signals to the control unit via the user interface. Such external sensors can e.g. be provided via a telephone, e.g. a Smartphone. In an embodiment, the hearing assistance device is adapted to allow a user—via the user interface—to configure a particular sensor providing a control input signal to the control unit, e.g. by setting threshold values for entering a low-power mode. The ability to add and/or configure particular sensors allow the customization of the procedure for switching a hearing assistance device to a low-power mode to the wishes and normal behaviour of a particular user. In an embodiment, the hearing assistance device is configured to allow at least a de-activation of a particular sensor from being used to provide inputs to the control unit. An example of such customization is the use of a storage box to store one or more hearing assistance devices when not in operation. If such storage box is NOT used by a particular user, a deactivation of a magnetic field sensor (e.g. a GMR sensor/switch) for sensing a permanent magnet in the storage box may preferably be deactivated (or alternatively activated, if such storage box with magnet is intended to be used).

In an embodiment, the activation of the low-power mode is influenced (controlled) by a combination of three or more, such as four or more, different control input signals to the control unit.

In an embodiment, the at least two or more or at least three or more control input signals are selected from at least two different of the group of signals (types of signals) 1), 2), 3), and 4). In an embodiment, the at least four or more control input signals are selected from at least three different of the group of signals 1), 2), 3), and 4). In an embodiment, each of the at least three or more (or four or more) control input signals are selected from a different of the group of signals 1), 2), 3), and 4).

1) Signals Relating to a Current Physical Environment of the Hearing Assistance Device:

In general, the term 'the physical environment of the hearing assistance device' is taken to include the current physical conditions around the hearing assistance device (acoustic as well as non-acoustic), e.g. the temperature, the relative humidity, electromagnetic field strengths (E-field, H-field), light intensity, relative movement, etc. Preferably, however, the 'physical environment of the hearing assistance device' is taken to mean the immediate physical environment around the hearing assistance device, e.g. limited by a distance normally providing sensory perception to a hearing assistance device and/or to a human being wearing the hearing assistance device. The 'physical environment' may be confined by a room or container (e.g. a storage box) where the hearing assistance device is currently located. Typically the detectors configured to provide signals relating to a current property of 'the physical environment' of the hearing assistance device are detectors of other parameters of the environment than the acoustic environment. In an embodiment, the term 'physical environment', is taken to mean the 'non-acoustic environment'.

In an embodiment, the hearing assistance device comprises one or more detectors configured to provide signals relating to a current physical environment of the hearing assistance device, e.g. a specific property or parameter. Alternatively or additionally, one or more of the signals relating to a current (property of the) physical environment of the hearing assistance device may be provided by a detector forming part of an external device in communication (e.g. wirelessly) with the hearing assistance device. An external device may e.g. comprise another hearing assistance device, a remote control, and audio delivery device, a telephone (e.g. a Smartphone), an external sensor, etc. In such case, the hearing assistance device preferably comprises a receiver (e.g. a wireless receiver) for receiving signals from external sensors for providing said signal relating to a current (property of the) physical environment of the hearing assistance device. Such internal or external environment detectors may e.g. comprise one or more of a proximity sensor, e.g. for detecting the proximity of an electromagnetic field (and possibly its field strength), the proximity of human skin, etc., a temperature sensor, a light sensor, a time indicator, a magnetic field sensor, a humidity sensor, a reverberation sensor, a movement sensor (e.g. an accelerometer or a gyroscope), etc.

2) Signals Relating to a Current Acoustic Environment of the Hearing Assistance Device:

Properties of the acoustic environment are typically reflected in signals of the forward path of the hearing assistance device (e.g. as picked up by an input transducer) or derivable there from and accounted for by detectors for analysing signals of the hearing assistance device. In an embodiment, the hearing assistance device comprises one or more detectors configured to analyse one or more signals of the hearing assistance device, e.g. one or more signals of the forward path (such analysis e.g. providing an estimate of a feedback path, an autocorrelation of a signal, a cross-correlation of two signals, an overall signal level, etc.) and/or to provide a signal relating to the current acoustic environment of the hearing assistance device. In an embodiment, the hearing assistance device comprises one or more detectors configured to analyse other properties of a signal of the forward path, e.g. the presence of a tone, the presence of speech (as opposed to noise or other sounds or no sounds), the presence of a specific voice, an estimate of an input level (e.g. a noise level), the presence of reverberation, etc. In an embodiment, such detector is additionally configured to analyse a signal received from another device (e.g. from a contra-lateral hearing assistance device of a binaural hearing assistance system; the detector may e.g. compare a signal of the hearing assistance device in question and a corresponding signal of the contra-lateral hearing assistance device of a binaural hearing assistance system). In an embodiment, the hearing assistance device is adapted to receive signals from external sensors of the acoustic environment, e.g. a separate microphone (e.g. located in a telephone or other device in (e.g. wireless) communication with the hearing assistance device). Another external sensor of the acoustic environment may e.g. be a reverberation sensor providing information about the reflections of an acoustic sound field surrounding the assistive listening device.

3) Signals Relating to a Current State of a Wearer of the Hearing Assistance Device:

In an embodiment, the hearing assistance device comprises one or more detectors configured to analyse properties of the user wearing the hearing assistance device to indicate a current state of the user, e.g. physical and/or mental state. In an embodiment, such detectors may include one or more of a motion sensor, a brainwave sensor, a sensor of cognitive load, a temperature sensor, a blood pressure sensor, an own voice detector, etc.

In an embodiment, the two or more control input signals to the control unit comprise first and second signals from first and second temperature sensors, including a signal indicating the temperature of the immediate environment of the hearing assistance device (e.g. the skin or body temperature of a user when the user wears the hearing assistance device) AND a signal indicating a temperature of the environment in a larger sense, e.g. the room temperature or the temperature of the location on a larger scale (e.g. at least 0.01 m, such as more than 0.1 m, such as more than 0.2 m from, e.g. outside a storage box of, the hearing assistance device). In an embodiment, the two or more control input signals to the control unit comprise a third signal from a movement detector, e.g. an accelerometer and/or a gyroscope.

4) Signals Relating to a Current State or Mode of Operation of the Hearing Assistance Device and/or of Another Device in Communication with the Hearing Assistance Device:

In an embodiment, the hearing assistance device comprises one or more detectors configured to analyse or indicate signals relating to a current state or mode of operation of the hearing assistance device (including characteristics of signals of the hearing assistance device, e.g. feedback) and/or of another device in communication with the hearing assistance device (e.g. a contra-lateral device of a binaural hearing aid system). Examples of a state or mode of operation of the hearing assistance device are e.g. present choice of program, battery status, amount of feedback present, status of a wireless link, low power mode, normal mode, directional or omni-directional microphone mode, etc.

The above mentioned detectors or sensors are preferably adapted to provide corresponding control input signals. Some of the detectors or sensors may—as the case may be—belong to more than one (or be included in either one of several) of the above defined the groups of signals 1), 2), 3), and 4).

Environment Classification:

In an embodiment, the hearing assistance device comprises a classification unit configured to classify the current situation based on input signals from (at least some of) the detectors, and possibly other inputs as well. The classification unit is configured to provide that the detector signals that—in a given 'current situation'—are used as the two or more control input signals to the control unit to decide on activation or deactivation of a low-power mode are signals from detectors that represent parameters or properties that complement each other in the current situation.

In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing assistance device, or other properties of the current environment than acoustic;

b) the current acoustic situation (input level, feedback, etc.), and c) the current mode or state of the user (movement, temperature, etc.);

d) the current mode or state of the hearing assistance device (program selected, time elapsed since last user interaction, etc.) and/or of another device in communication with the hearing assistance device.

In an embodiment, the control unit is configured to use the current classification to apply a weight (w, e.g. between 0 and 1) to a given control input signal to the control unit to thereby evaluate its importance regarding the control of the activation or deactivation of a low-power mode of operation of the hearing assistance device. In other words, a given control input signal (from a given detector) may have a different (e.g. no (e.g. w=0) or full (e.g. w=1) or medium (e.g. w=0.5)) influence on the activation or deactivation of a low-power mode in different situations (depending on the classification of the situations in question). Thus, the control unit may be configured to dynamically select the most relevant of the control input signals to influence the decision on activation or deactivation of a low-power mode depending on the classification of the current situation.

Detectors (Exemplary):

The hearing assistance device may include (or receive inputs signals from) a multitude of (internal or external) sensors configured to monitor physical (incl. acoustic) properties (e.g. parameters) of the environment, the wearer and the state of the hearing assistance device.

In an embodiment, the two or more detectors providing the (possible) control input signals comprise a level detector (HA) for determining the level of an input signal (e.g. on a band level and/or of the full (wide band) signal). The input level of the electric microphone signal picked up from the user's acoustic environment is e.g. a classifier of the environment. In an embodiment, the level detector is adapted to classify a current acoustic environment of the user according to a number of different (e.g. average) signal levels, e.g. as a HIGH-LEVEL or LOW-LEVEL environment. Level detection in hearing aids is e.g. described in WO 03/081947 A1 or U.S. Pat. No. 5,144,675.

In a particular embodiment, the two or more of detectors providing the (possible) control input signals comprise a voice detector (VD) for determining whether or not an input signal comprises a voice signal (at a given point in time). A voice signal is in the present context taken to include a speech signal from a human being. It may also include other forms of utterances generated by the human voice system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE. Examples of voice detector circuits are e.g. described in WO 91/03042 A1 and in US 2002/0147580 A1.

In an embodiment, the two or more detectors providing the (possible) control input signals comprise an own voice detector for detecting whether a given input sound (e.g. a voice) originates from the voice of the user of the system. In an embodiment, the microphone system of the hearing assistance device is adapted to be able to differentiate between a user's own voice and another person's voice and possibly NON-voice sounds. Aspects of own voice detection are e.g. described in WO 2004/077090 A1 and in EP 1 956 589 A1.

In an embodiment, the two or more detectors providing the (possible) control input signals comprise a cross correlation detector to estimate a cross correlation or convolution between a signal from the input side (e.g. a signal from an input transducer, cf. e.g. microphone MIC in FIG. 4) and a signal from the output side (e.g. the signal to be presented for a user via an output transducer, cf. e.g. speaker SPK in FIG. 4). The cross correlation of two digitized (e.g. complex) signals u[n] and y[n] (the signals e.g. defined in a time-frequency framework) is defined by the following formula:

$$(u^* y)[n] = \sum_{m=-\infty}^{\infty} u^*[m] \cdot y[n+m]$$

where u*[m] denotes the complex conjugate of u[m]. An appropriate estimate thereof is typically sufficient to achieve acceptable results for the present purpose. Cross-correlation between two signals and/or auto-correlation of a signal of the forward path can contribute to the classification of the acoustic environment of the hearing assistance device.

In an embodiment, the two or more detectors providing the (possible) control input signals comprise a magnetic field sensor, (e.g. forming part of a GMR switch, GMR=Giant MagnetoResistance) for sensing the proximity of a (e.g. static or varying) magnetic field (e.g. a static field from a permanent magnet in a storage box) and performing a switch operation. A high static magnetic field above a predefined threshold value indicates the proximity of a permanent magnet. A permanent magnet may be located in a storage box or other location where the hearing assistance device is intended to be stored while not in use, and hence used as an indicator to activate a low-power mode of the hearing assistance device. The magnetic field sensor may advantageously be used for other tasks (than those related to the present disclosure) in the hearing assistance device, e.g. for detecting a telephone mode, where a telephone apparatus is positioned near an ear (with a hearing assistance device) of a user. A permanent magnet located in a telephone apparatus may e.g. be used by a hearing assistance device (e.g. a hearing aid) to switch to a specific telephone reception mode, when the telephone apparatus is brought into proximity of the hearing assistance device. Various uses of magnetic field sensors in connection with interfacing hearing aids and telephones are e.g. discussed in US2002186857A, US2004252855A, US2007253584A, and GB1254017A.

In an embodiment, the two or more detectors providing the (possible) control input signals comprise a detector of the current strength of an (varying) electromagnetic field, e.g. an inductive (near-)field. US2009087005A describes the use of a field strength sensor to detect whether two hearing aids are in close proximity of each other (e.g. located in a storage box).

In an embodiment, the two or more detectors providing the (possible) control input signals comprise a feedback estimation unit for providing an estimate of the current feedback from an output transducer to an input transducer of the hearing assistance device. In an embodiment, the feedback estimation unit comprises an adaptive filter, the adaptive filter comprising a variable filter part, and an algorithm part comprising an adaptive algorithm, the variable filter part being adapted for providing a transfer function to a filter input signal and providing a filtered output signal, the transfer function being controlled by filter coefficients determined in the algorithm part and transferred to the variable filter part. In an embodiment, the hearing assistance device further comprises a memory wherein values of feedback gains (e.g. at different frequencies) for a number feedback paths expected to occur when handling and using the hearing assistance device are stored. In an embodiment, the hearing assistance device further comprises an analysis unit for comparing an estimated current feedback gain with said values of feedback gains stored in said memory and thereby classifying the current feedback estimate relative to said stored feedback gains. In an embodiment, classification is based on a comparison of the sum of squared differences between the measured acoustic path transfer function and stored reference transfer functions at selected frequencies. A criterion for classifying the current feedback path as corresponding to one of the stored feedback paths may be that the calculated difference is smaller than a predefined threshold value. In an embodiment, at least one of the stored feedback paths corresponds to a situation where the hearing assistance device is not operatively worn by the user (e.g. located in a storage box or at a surface, e.g. of a table). In an embodiment, one or more frequency ranges of the estimated feedback path having a feedback gain larger than 0 dB is taken to be indicative of a hearing assistance device being located in a (storage) container. A control signal indicating the conclusion may be communicated to the control unit (as a control input signal), which evaluates the control signal together with other control signals and based thereon automatically concludes whether or not the hearing assistance device should be brought into to a low-power mode to conserve the battery.

In an embodiment, the two or more detectors providing the (possible) control input signals comprise a temperature sensor adapted to log temperature over time to be able to determine a rate of change of temperature. In an embodiment, the temperature sensor is configured for measuring the body or skin temperature of the wearer of the hearing assistance device (e.g. at those parts of the hearing assistance device that have skin contact while the hearing assistance device is being worn). In an embodiment, the control unit is configured to take as an indication that the hearing assistance device is not being worn if the measured temperature has decreased more than a predefined value, e.g. more than 1° K, or more than 2° K, or more than 5° K, within a predefined time span, e.g. within the last 5 minutes, or within the last hour. In an embodiment, the hearing assistance device is configured to receive a control input from an external temperature sensor, e.g. providing a current temperature of the environment.

In an embodiment, the two or more detectors providing the (possible) control input signals comprise a light intensity sensor (e.g. located at a place on the hearing assistance device's shell that is covered with or touches the user's skin while the hearing assistance device is worn and (probably) less covered when the hearing assistance device is not worn).

In an embodiment, the two or more detectors providing the (possible) control input signals comprise a body sound detector (e.g. the sound of the human heart beat while the hearing assistance device is worn). This parameter can contribute to indicating a current state of the user (asleep vs. exercising, e.g. or worn, not worn), e.g. by comparison with stored reference values.

In an embodiment, the two or more detectors providing the (possible) control input signals comprise an electrical conductivity detector (e.g. the conductivity between contact points on the housing of the hearing assistance device, e.g. of human skin while the hearing assistance device is worn to thereby contribute to decide whether or not the hearing assistance device is currently being worn, e.g. by comparison with stored reference values).

In an embodiment, the two or more detectors providing the (possible) control input signals comprise a detector of force exerted on the hearing assistance device.

In an embodiment, the two or more detectors providing the (possible) control input signals comprise a movement detector, e.g. an accelerometer for detecting a linear movement of the hearing assistance device, and/or a detector of a change of angular momentum on the hearing assistance device (e.g. gyroscope). These parameters can contribute to indicating a current state of the user (asleep vs. exercising, etc. or a state or environmental condition of the hearing assistance device, worn or not worn). MEMS acceleration sensors are e.g. available from Bosch Sensortec or Analog Devices.

In an embodiment, the two or more detectors providing the (possible) control input signals comprise a detector of brain waves to indicate present state of mind or cognitive load (e.g. using EEG-electrodes on a shell or housing part of the hearing assistance device, cf. e.g. EP2200347A2).

In an embodiment, the two or more detectors providing the (possible) control input signals comprise a detector of the current state (or mode of operation) of the hearing assistance device. Examples of the current state of the hearing assistance device are low-power mode or other (normal) mode, and if not in low-power mode: what kind of hearing assistance program is currently activated (music, 1-1-conversation, TV, telephone, multi-talker, speech in noise, etc.), whether the microphone system is in an omnidirectional state or a directional state, experiences feedback, etc.

A Control Unit for Combination of Output Signals from Different Detectors

According to the present disclosure the low-power mode of the hearing assistance device is activated (or deactivated) based on observation of properties (e.g. physical parameters) of the hearing assistance device, the wearer of the hearing assistance device and/or the (acoustic and/or non-acoustic) environment of the (wearer and) hearing assistance device.

The control unit is configured to combine the two or more control input signals (from two or more detectors of different kinds) as a basis for a decision whether or not to enter or leave a low-power mode.

In an embodiment, the control unit is configured to output a resulting signal indicative of "the hearing assistance device is being worn" or "the hearing assistance device is not being worn", and e.g. indicating whether or not the low-power state should be left or entered, respectively. In an embodiment, the output of the control unit is a binary signal (e.g. taking values LP indicating 'switch to' (or stay in low-power mode), and NORM indicating 'switch to' (or stay in a normal mode of operation). In an embodiment, the hearing assistance device is configured to apply a predetermined scheme for fully or partially powering functional blocks down, when the resulting output signal of the control input indicates that the hearing assistance device is NOT being worn (thereby activating the low-power mode).

In an embodiment, the control unit is configured to provide a more complex output signal, indicating which of a multitude of functional blocks of a hearing assistance device to switch in or out of operation depending on the combination of values of the at least two control input signals.

In an embodiment, the hearing assistance device comprises a switch unit configured to switch individual functional components (or groups of functional components) in and out of operation (by fully or partially enabling and disabling, respectively, the power supply to the functional components in question) based on an output signal from the control unit.

In an embodiment, the two or more control input signals at least comprise a signal (from a detector) relating to (a property of) the current physical environment (other than the acoustic environment) AND a signal (from a detector) relating to a current acoustic environment (e.g. as reflected by (a property of) signal(s) from the forward path of the hearing assistance device).

In an embodiment, the two or more control input signals at least comprise a) a signal from one or more detectors for classifying an acoustic environment around the hearing assistance device AND b) a signal from a detector relating to a current state or mode of operation of the hearing assistance device. Examples of such detectors are a) a level detector, a speech or voice detector, a tone or howl detector, an autocorrelation detector, a silence detector, and b) a feedback change detector, a directionality detector, etc.

In an embodiment, the two or more control input signals at least comprise a signal from one or more detectors for classifying an acoustic environment around the hearing assistance device AND/OR a signal relating to (a property of) the current physical environment other than the acoustic environment around the hearing assistance device, AND a signal from a detector relating to a current state of a wearer of the hearing assistance device.

In an embodiment, the two or more control input signals to the control unit at least comprise an output signal from a detector relating to signal(s) of the forward path of the hearing assistance device AND an output signal from a detector relating to a property of signal(s) received by the hearing assistance device from another device. In an embodiment, signal(s) received by the hearing assistance device from another device are signals from a contra-lateral hearing assistance device of a binaural hearing assistance system and correspond to signal from a detector relating to signal(s) of the forward path of the contra-lateral hearing assistance device allowing a (direct) comparison of the two (corresponding) signals.

In an embodiment, the two or more control input signals to the control unit at least comprises a detector output signal from a detector for classifying an acoustic environment of the hearing assistance device AND a detector output signal from a detector of the electromagnetic environment of the hearing assistance device.

In an embodiment, the hearing assistance device is configured to use the present scheme for switching from a normal mode to a low-power mode of operation AND from a low-power mode to a normal mode of operation. In an embodiment, the hearing assistance device is configured to—when the hearing assistance device is in a low-power mode of operation—supply sufficient power to the control unit and to (one or more) detector units that provide input control signals to the control unit, which are used to decide whether the hearing assistance device should enter a normal mode of operation (deactivate or leave the low-power mode).

In an embodiment, the control input signals that are used to decide on switching from a normal mode to a low-power mode of operation and the reverse are identical. Alternatively, one or more (such as all) of the control input signals that are used to decide on switching from a normal mode to a low-power mode of operation may be different from the control input signals that are used to decide on switching from a low-power mode to a normal mode of operation.

In an embodiment, the hearing assistance device is configured to only use the present scheme for deciding whether or not a hearing assistance device should be in a normal mode of operation or in a low-power mode of operation for switching from a normal mode of operation to a low-power mode of operation (not the other way).

(Possible) Other Elements of the Hearing Assistance Device:

In an embodiment, the hearing assistance device is adapted to provide a frequency dependent gain to compensate for a hearing loss of a user. In an embodiment, the hearing assistance device comprises a signal processing unit for enhancing the input signal comprising an audio signal and providing a processed output signal. Various aspects of digital hearing aids are described in [Schaub; 2008].

In an embodiment, the output unit comprises an output transducer adapted for converting an electric signal to a stimulus perceived by the user as an acoustic signal. In an embodiment, the output unit is adapted to provide stimuli for a vibrator of a bone conducting hearing device. In an embodiment, the output unit comprises a receiver (speaker) for providing the stimulus as an acoustic signal to the user. In an embodiment, the output unit is adapted to provide stimuli for electrodes of a cochlear implant hearing aid device. In an embodiment, the output unit comprises an antenna and transceiver circuitry for wirelessly transmitting the electric output signal to another device (e.g. an external device or an implanted device).

In an embodiment, the input unit comprises an input transducer adapted for converting an input sound to an electric input signal. In an embodiment, the input transducer comprises a microphone, such as a multitude of microphones. In an embodiment, the hearing assistance device comprises a directional microphone system adapted to enhance a target acoustic source among a multitude of acoustic sources in the local environment of the user wearing the hearing assistance device. In an embodiment, the directional system is adapted to detect (such as adaptively detect) from which direction a particular part of the microphone signal originates.

In an embodiment, the hearing assistance device comprises an input unit in the form of an antenna and transceiver circuitry for wirelessly receiving (and extracting) the electric input signal from another device, e.g. a communication device or another hearing assistance device. In an embodiment, the wirelessly received signal represents or comprises an audio signal and/or a control signal and/or an information signal. In an embodiment, the hearing assistance device comprises demodulation circuitry for demodulating the wirelessly received signal to provide the electric input signal representing an audio signal and/or a control signal e.g. for setting an operational parameter (e.g. volume) and/or a processing parameter of the hearing assistance device (e.g. an updated parameter for an algorithm) and/or an information signal (e.g. a signal from a detector). In general, the wireless communication link established between an external transmitter and antenna and transceiver circuitry of the hearing assistance device can be of any type. The wireless communication link is used under power constraints, in that the hearing assistance device comprises or is constituted by a portable (e.g. battery driven) device. In an embodiment, the wireless communication link is a link based on near-field communication, e.g. an inductive link based on an inductive coupling between antenna coils of transmitter and receiver parts. In another embodiment, the wireless link is based on far-field, electromagnetic radiation.

In an embodiment, the energy source of the hearing assistance device comprises a battery, e.g. a rechargeable battery (e.g. a Nickel-metal hydride or a Lithium-Ion battery). In an embodiment, the energy source has a maximum capacity of 1000 mAh, such as 500 mAh. In an embodiment, the energy source of the hearing assistance device provides less than 5 days of normal operation, such as less than 3 days of normal operation.

The hearing assistance device comprises a forward or signal path between, the input unit (e.g. a microphone system and/or a direct electric input (e.g. a wireless receiver)) and the output unit. In an embodiment, the signal processing unit is located in the forward path. In an embodiment, the signal processing unit is adapted to provide a frequency dependent gain according to a user's particular needs. In an embodiment, the hearing assistance device comprises an analysis path comprising functional components for analyzing the input signal (e.g. one or more detectors, e.g. for determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain. In an embodiment, a mixture of time domain and frequency domain processing is implemented in the hearing assistance device.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples $x_n$ (or x[n]) at discrete points in time $t_n$ (or n), each audio sample representing the value of the acoustic signal at $t_n$ by a predefined number $N_s$ of bits, $N_s$ being e.g. in the range from 1 to 16 bits. In an embodiment, the hearing assistance device comprises a digital-to-analogue (DA) converter to convert a digital signal to an analogue output signal, e.g. for being presented to a user via an output unit, e.g. an output transducer.

In an embodiment, the hearing assistance device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range.

In an embodiment, the hearing assistance device comprises an acoustic (and/or mechanical) feedback estimation and suppression system.

In an embodiment, the hearing assistance device further comprises other relevant functionality for the application in question, e.g. compression, noise reduction, etc.

In an embodiment, the hearing assistance device comprises a hearing aid, e.g. a hearing instrument, e.g. a hearing instrument adapted for being located at the ear or fully or partially in the ear canal of a user (or comprising an implanted part), e.g. a headset, an earphone, an ear protection device or a combination thereof.

Use:

In an aspect, use of a hearing assistance device as described above, in the 'detailed description of embodiments' and in the claims, is moreover provided. In an embodiment, use is provided in a system comprising one or more hearing instruments, headsets, ear phones, active ear protection systems, etc.

A Method:

In an aspect, a method of providing a low-power mode in a portable hearing assistance device, the portable hearing assistance device comprising

- an input unit for providing an electric input signal comprising an audio signal,
- an output unit for providing an output signal originating from the audio signal,
- a forward path between the input unit and the output unit, and
- an energy source for energizing components of the hearing assistance device is furthermore provided by the present application.

The method comprises

- providing a low-power mode and a normal mode of operation of the hearing assistance device, wherein—when said low-power mode is activated—the draw of current from said energy source is reduced compared to a normal mode of operation of the hearing assistance device;
- controlling the activation of said low-power mode of operation of the hearing assistance device by providing that the activation of said low-power mode is influenced by a combination of at least two different control input signals, each control input signal being a signal selected from the group of signals comprising
  1) signals relating to a current physical environment of the hearing assistance device,
  2) signals relating to a current acoustic environment of the hearing assistance device,
  3) signals relating to a current state of a wearer of the hearing assistance device, and
  4) signals relating to a current state or mode of operation of the hearing assistance device and/or of another device in communication with the hearing assistance device.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the at least two different control input signals are selected from at least two different of said types of signals 1), 2), 3) or 4).

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing Assistance System:

In a further aspect, a hearing assistance system comprising a hearing assistance device as described above, in the 'detailed description of embodiments', and in the claims, AND an auxiliary device is moreover provided.

In an embodiment, the system is adapted to establish a communication link between the hearing assistance device and the auxiliary device to provide that information (e.g. control and status signals (e.g. a signal from a detector, e.g. a control input signal), possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing assistance device. In an embodiment, the auxiliary device is or comprises a remote control for controlling functionality and operation of the hearing assistance device(s). In an embodiment, the auxiliary device is or comprises an audio delivery device, an entertainment device, e.g. a music player, or a device delivering audio signals from a TV or other video media. In an embodiment, the auxiliary device is a telephone apparatus, e.g. a mobile telephone, e.g. a Smartphone, a PC (personal computer, e.g. a tablet computer), or a combination thereof.

In an embodiment, the hearing assistance system, e.g. the auxiliary device, comprises a user interface adapted to allow a user to add and/or configure a particular external sensor to provide a control input signal to the control unit. In an embodiment, the hearing assistance system, e.g. the auxiliary device, comprises a user interface adapted to allow a user to deactivate a particular external sensor to provide a control input signal to the control unit.

In an embodiment, the auxiliary device is another hearing assistance device. In an embodiment, the hearing assistance system comprises two hearing assistance devices adapted to implement a binaural hearing assistance system, e.g. a binaural hearing aid system.

In an embodiment, the two hearing assistance devices of a binaural hearing assistance system are adapted to exchange status, control, and/or and other information signals between them. In an embodiment, the two hearing assistance devices are adapted to exchange at least one of their respective control input signals. In an embodiment, the respective control units of the two hearing assistance devices are adapted to compare their respective corresponding control input signals and to use the result thereof as an input to controlling the activation or deactivation of said low-power mode of operation of the hearing assistance device.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Figure 1A:
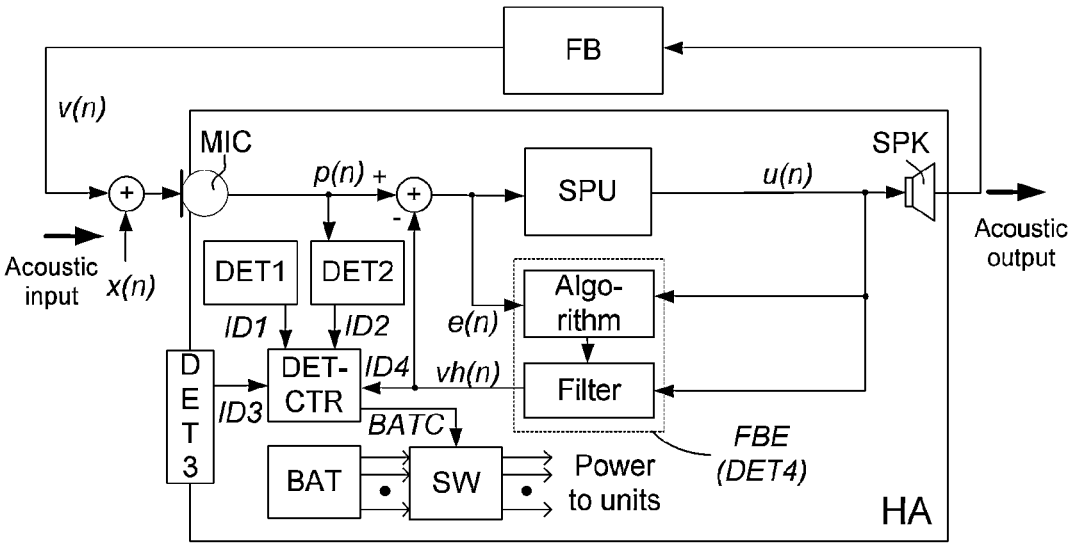
FIG. 1 shows a first embodiment of a hearing assistance device according to the present disclosure (FIG. 1*a*) and an example of a corresponding combination of control inputs providing a resulting output from the control unit to govern the switching of the hearing assistance device between a normal mode and a low-power mode of operation (FIG. 1*b*)

FIG. 1 shows a first embodiment of a hearing assistance device according to the present disclosure (FIG. 1*a*) and an example of a corresponding combination of control inputs providing a resulting output from the control unit to govern the switching of the hearing assistance device between a normal mode and a low-power mode of operation (FIG. 1*b*). FIG. 1*a* shows a portable hearing assistance device (HA) comprising an input transducer (MIC, here a microphone, also referred to herein as an "input unit"), an output transducer (SPK, here a loudspeaker, also referred to herein as an "output unit"), and a forward path between the input transducer and the output transducer, the forward path comprising a signal processing unit (SPU). The hearing assistance device further comprises an energy source (BAT, e.g. a battery) for energizing components of the hearing assistance device (including the input and output transducers and the signal processing unit). The hearing assistance device further comprises a control unit (DET-CTR) configured to control at least the activation (and possibly additionally the deactivation) of a low-power mode of operation of the hearing assistance device based on a number of control inputs ID1, ID2, ID3, and ID4 from detectors DET1, DET2, DET3, and DET4 (FBE), respectively. The low-power mode (wherein the draw of current from the energy source (BAT) is reduced compared to a normal mode of operation of the device) is implemented by a switch unit (SW) configured to (individually or simultaneously) enable of disable the power supply to selected functional blocks (or groups of blocks) of the hearing assistance device, e.g. including the signal processing unit (or at least a part thereof), cf. signals Power to units. The switch unit (SW) is controlled by a control signal BATC from the control unit (DET-CTR). The control signal BATC for influencing the activation (and possibly the deactivation) of a low-power mode (involving powering down or up, respectively, of selected functional blocks) of the hearing assistance device is generated based on two or more of the control input signals ID1, ID2, ID3, and ID4 to the control unit. The control input signals ID1, ID2, ID3, and ID4 are selected from the group of signals comprising
1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device.

The signal processing unit (SPU) is preferably configured for applying a frequency dependent gain to the signal p(n) provided by the input transducer (MIC) (or rather a signal e(n) originating there from) and for providing an enhanced signal u(n) to the output transducer (SPK). The index n represents a time index. The signals may be processed in the time domain (in which case n may be a sample index) or in the frequency domain (in which case n may be a time frame index). In an embodiment, the hearing assistance device comprises a hearing aid, wherein the frequency dependent gain applied by the signal processing unit is adapted to a user's hearing impairment. The hearing assistance device further comprises a feedback cancellation system (feedback estimation unit FBE (also denoted detector DET4) and sum-unit '+') for estimating and reducing (or preferably cancelling) acoustic feedback from an 'external' feedback path (FB) from the output to the input transducer of the hearing assistance device. The feedback estimation unit FBE comprises an adaptive filter comprising a variable filter part (Filter in FIG. 1*a*), which is controlled by a prediction error algorithm (Algorithm in FIG. 1*a*), e.g. an LMS (Least Means Squared) algorithm, in order to predict and cancel the part of the microphone signal p(n) that is caused by feedback from the loudspeaker (SPK) of the hearing assistance device. The prediction error algorithm (Algorithm) uses a reference signal (here the output signal u(n)) together with a signal originating from the microphone signal (here the so-called 'error signal' e(n)) to find the setting (filter coefficients) of the variable filter (Filter) that minimizes the prediction error when the reference signal u(n) is applied to the adaptive filter. The estimate vh(n) of the feedback path provided by the adaptive filter is subtracted from the microphone signal p(n) in sum unit '+' providing the error (or feedback-corrected) signal e(n), which is fed to the signal processing unit (SPU) and to the algorithm part (Algorithm) of the adaptive filter.

The detectors DET1, DET2, DET3, and DET4 (FBE) may e.g. include sensors providing signals from the four types of signals 1), 2), 3), 4) mentioned above. In an embodiment, DET1 is a sensor providing signals relating to a current physical environment of the hearing assistance device. DET1 may e.g. comprise a movement sensor, e.g. an acceleration sensor for detecting a linear acceleration of the hearing assistance device and/or a gyroscope sensor for detecting a rotational acceleration of the hearing assistance device. Such sensors are e.g. available from Bosch (cf. e.g. MEMS sensor BMX055, comprising both). In an embodiment, DET2 is a sensor providing signals relating to a current acoustic environment of the hearing assistance device. DET2 may e.g. comprise a level detector, a voice activity detector, and/or a wind noise detector. In an embodiment, DET3 is a sensor providing signals relating to a current state of a wearer of the hearing assistance device. In an embodiment, DET3 comprises a temperature sensor for monitoring a temperature of the local environment of the hearing assistance device (e.g. the skin temperature of a user of the hearing assistance device, when the hearing assistance device is worn by the user in a normal, operational position). Alternatively, DET3 comprises electrodes for measuring brain waves of the user (when the hearing assistance device is being worn in a normal, operational position). In an embodiment, DET4 is a sensor providing signals relating to a current state or mode of operation of the hearing assistance device. In an embodiment (as shown in FIG. 1*a*), DET4 comprises a feedback estimation unit (FBE) providing an estimate (signal ID4/vh(n)) of a current feedback from the output transducer (SPK) to an input transducer (MIC).

The control unit (DET-CTR) is configured to control the activation (and possibly deactivation) of a low-power mode of operation of the hearing assistance device, based on a (e.g. logic or predefined, e.g. tabulated) combination of the four control inputs ID1, ID2, ID3, and ID4. FIG. 1*b* provides an example of a (tabulated) combination of the control input signals ID1, ID2, ID3, and ID4 to provide a reliable decision (via control signal BATC to the switch unit (SW)) to activate (and possibly deactivate) a low-power mode of the hearing assistance device. In the example of FIG. 1*b*, the control input signals are assumed to take on binary values (e.g. 0 or 1, or as here 'state values'). Detector 1 (DET1) providing control input signal ID1 is assumed to comprise a movement detector configured to indicate whether the hearing assistance device is in movement (ID1=MOVE) or not (ID1=STILL). Detector 2 (DET2) providing control input signal ID2 is assumed to comprise a voice activity detector configured to indicate whether the acoustic environment of the hearing assistance device (as extracted from the input signal p(n) of the microphone) comprises a voice (e.g. speech) (ID2=VOICE) or not (ID2=NO VOICE). Detector 3 (DET3) providing control input signal ID3 is assumed to comprise a temperature sensor configured to indicate whether the temperature in the immediate vicinity of the hearing assistance device is above (ID3=$T \geq T_{th}$) or below (ID3=$T < T_{th}$) a reference temperature $T_{th}$ (exemplified by 35° C. in FIG. 1*b*). Detector 4 (DET4) providing control input signal ID4 is assumed to comprise feedback estimation unit configured to indicate whether the current feedback (e.g. represented by a feedback measure) in the hearing assistance device is above (ID4=$FB \geq X_{th}$) or below (ID4=$FB < X_{th}$) a reference feedback value $X_{th}$. The 16 possible combinations of the 4 binary input signals are provided and the resulting output signal (BATC) from the control unit to the switch unit (SW) is indicated for each of the 16 combinations. The resulting output signal (BATC) is indicated as NORM and as LP, in case a normal mode of operation and a low-power mode of operation, respectively, is assumed to be the more relevant for the given combination of control input signals. The column 'Comment' indicates for each combination of input signals to and resulting output signal from the control unit a possible situation. For each input signal ID1-ID4 one of its binary values is taken to indicate a situation where the hearing assistance device is assumed to be worn (white background, e.g. ID3=T≥35° C.), the other that it is assumed NOT to be worn (grey background, e.g. ID3=T<35° C.). For some of the combinations of the input signal values, no completely un-ambiguous conclusion can be drawn. The strategy applied in FIG. 1*b* for arriving at an output signal value of BATC=LP has been to require that a majority (here at least three) of the input signal values to 'imply' a situation where the hearing aid is not being worn (i.e. at least 3 fields have a grey background). The reason behind this strategy is to minimize the risk of powering the hearing assistance device in situations where it should not be powered down. Of course this may be at the risk of NOT powering the hearing assistance device down in some cases where it preferably should have been. In a preferred embodiment, a control input signal from an environment temperature sensor (e.g. from an external device, e.g. a wireless thermometer or a Smartphone, cf. FIG. 2) is provided to the control unit to complement the 'body temperature' sensor (DET3 in FIG. 1). Thereby a more safe conclusion regarding whether or not the hearing assistance device is in contact with the body of a user can be made.

Figure 2:
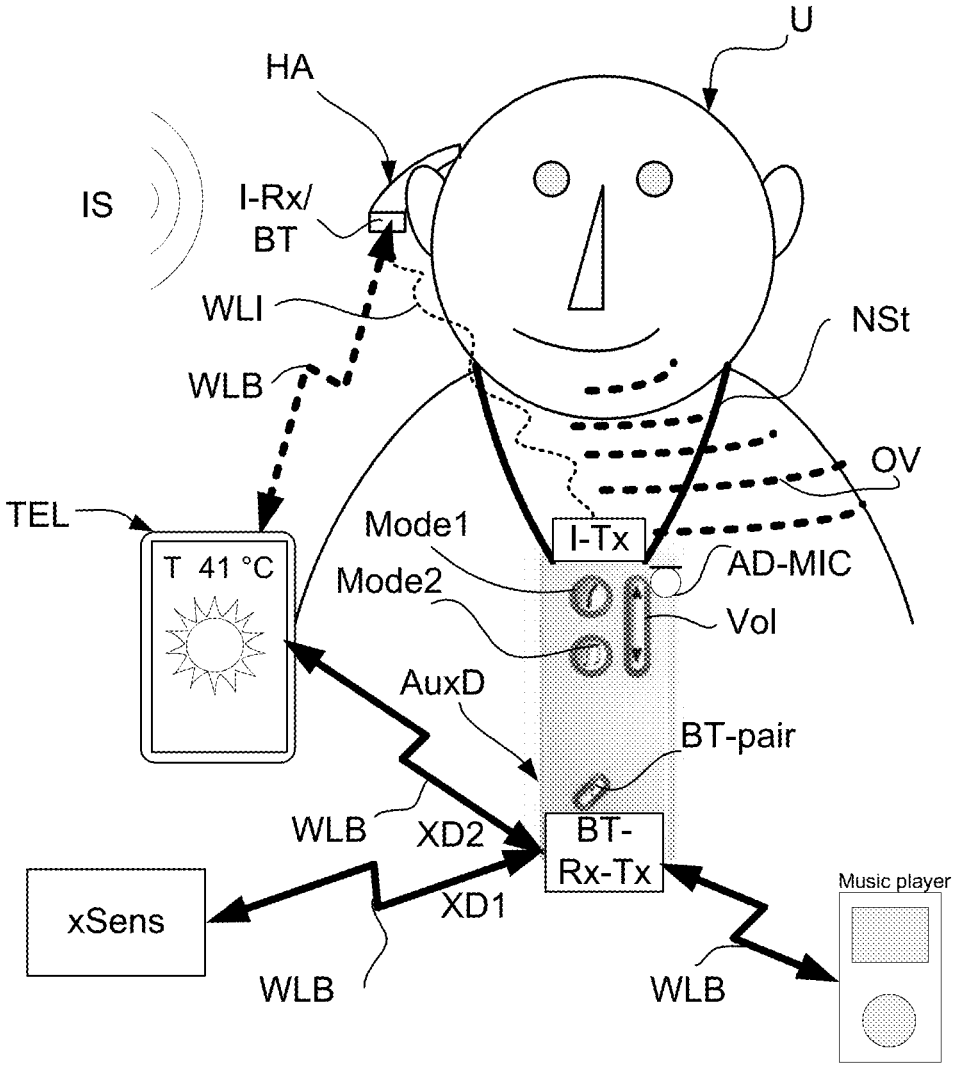
FIG. 2 shows an embodiment of a hearing assistance system comprising a hearing assistance device and an auxiliary device, here an audio gateway device or a telephone, and a number of external sensors, the system being adapted for establishing communication links between at least some of the devices.

FIG. 2 shows an embodiment of a hearing assistance system comprising a hearing assistance device and an auxiliary device, here an audio gateway device or a telephone, and a number of external sensors, the system being adapted for establishing communication links between at least some of the devices. The hearing assistance system comprises a hearing assistance device HA and an auxiliary device AuxD. The auxiliary device AuxD is shown to comprise an audio gateway device adapted for receiving a multitude of audio signals (here shown from a telephone apparatus, e.g. a wireless telephone TEL (e.g. a Smartphone having access to a data network, e.g. the Internet), an entertainment device (here a Music player). Additionally, the auxiliary device is adapted to receive a signal from a sensor device xSens and to transfer it to the hearing assistance device.

The auxiliary device AuxD comprises a microphone (AD-MIC) for picking up sounds from the environment, e.g. a voice (OV) of the user (U) wearing the portable hearing assistance system (or of another person in the environment). In the embodiment of FIG. 2, the auxiliary device AuxD is adapted for connecting the microphone (AD-MIC) to one or more of the external audio sources (including the telephone TEL) via wireless links WLB, here in the form of digital transmission links according to the Bluetooth standard as indicated by the Bluetooth transceiver (BT-Tx-Rx) in the auxiliary device AuxD. The audio sources and the auxiliary device may be paired prior to the establishment of a wireless link between them using the button BT-pair on the auxiliary device. The wireless links WLB may alternatively be implemented in any other convenient wireless and/or wired manner, and according to any appropriate modulation type or transmission standard, possibly different for different audio sources. The intended mode of operation of the hearing assistance system (incl. the selection of the audio source) can be selected by the user via mode selection buttons Mode1 and Mode2. The auxiliary device AuxD may further have the function of a remote control of the hearing assistance device, e.g. for changing program or operating parameters (e.g. volume, cf. Vol-button) in the hearing assistance device.

The hearing assistance device HA is shown as a device mounted at the ear of a user U. The hearing assistance device may be a hearing assistance device as discussed in connection with FIG. 1 and e.g. comprise a microphone for picking up a sound signal IS (e.g. comprising a speech and/or a noise signal) in the environment of the hearing assistance device. The hearing assistance device HA of the embodiment of FIG. 2 additionally comprises a wireless transceiver, here indicated to be based on inductive communication (I-Rx). The transceiver (at least) comprises an inductive receiver (i.e. an inductive coil, which is inductively coupled to a corresponding coil in a transceiver (I-Tx) of the auxiliary device AuxD), which is adapted to receive the audio signal from the auxiliary device (either as a baseband signal or as a modulated (analogue or digital) signal, and in the latter case to extract the audio signal from the modulated signal). The inductive link WLI between the auxiliary device and the hearing assistance device is indicated to be one-way, but may alternatively be two-way (e.g. to be able to exchange control signals between (mainly) transmitting AuxD and receiving HA device, e.g. to agree on an appropriate transmission channel). Alternatively or additionally, the hearing assistance device (and/or the auxiliary device) may be adapted to receive an audio and/or an information signal directly from a telephone (e.g. a Smartphone) as e.g. indicated by the dotted arrow (WLB) between the telephone apparatus (TEL) and the hearing assistance device (HA) and the additional Bluetooth transceiver indicated by BT in the hearing assistance device HA. In an embodiment, the telephone apparatus and the hearing assistance device are configured to allow the direct link between them to be based on the Bluetooth-Low Energy (BT-LE) standard. In such scenario, the telephone apparatus may be viewed as the auxiliary device of the hearing assistance system (instead of or in addition to the audio gateway device). In the example of FIG. 2, the telephone apparatus is assumed to have access to a network, e.g. the Internet, and/or to comprise one or more sensors, e.g. a temperature sensor, a location sensor, a movement sensor, etc. One or more signals from such sensors are assumed to be transmitted (or transferable) to the hearing assistance device HA either directly (via link WLB) or via the (intermediate) auxiliary device AuxD (and link WLI). In FIG. 2, the environmental temperature T=41° C. shown on the display of the Smartphone (TEL) is transferred to the hearing assistance device and used as a control input signal to the control unit.

The sensor device xSens is wirelessly connected to the hearing assistance device HA via the auxiliary device AuxD. The wireless link between the external sensor xSens and the auxiliary device AuxD may preferably be based on the BT-LE standard. In an embodiment, the link from the external sensor xSens is a direct link to the hearing assistance device HA (e.g. according to BT-LE). In an embodiment, the external sensor device xSens is a sensor of the temperature of the environment (e.g. a room) of the hearing assistance device.

The auxiliary device AuxD is shown to be carried around the neck of the user U in a neck-strap NSt. Alternatively, the auxiliary device may be carried in other ways, e.g. in the hand, in a pocket, clipped on clothing, etc.

Figure 3:
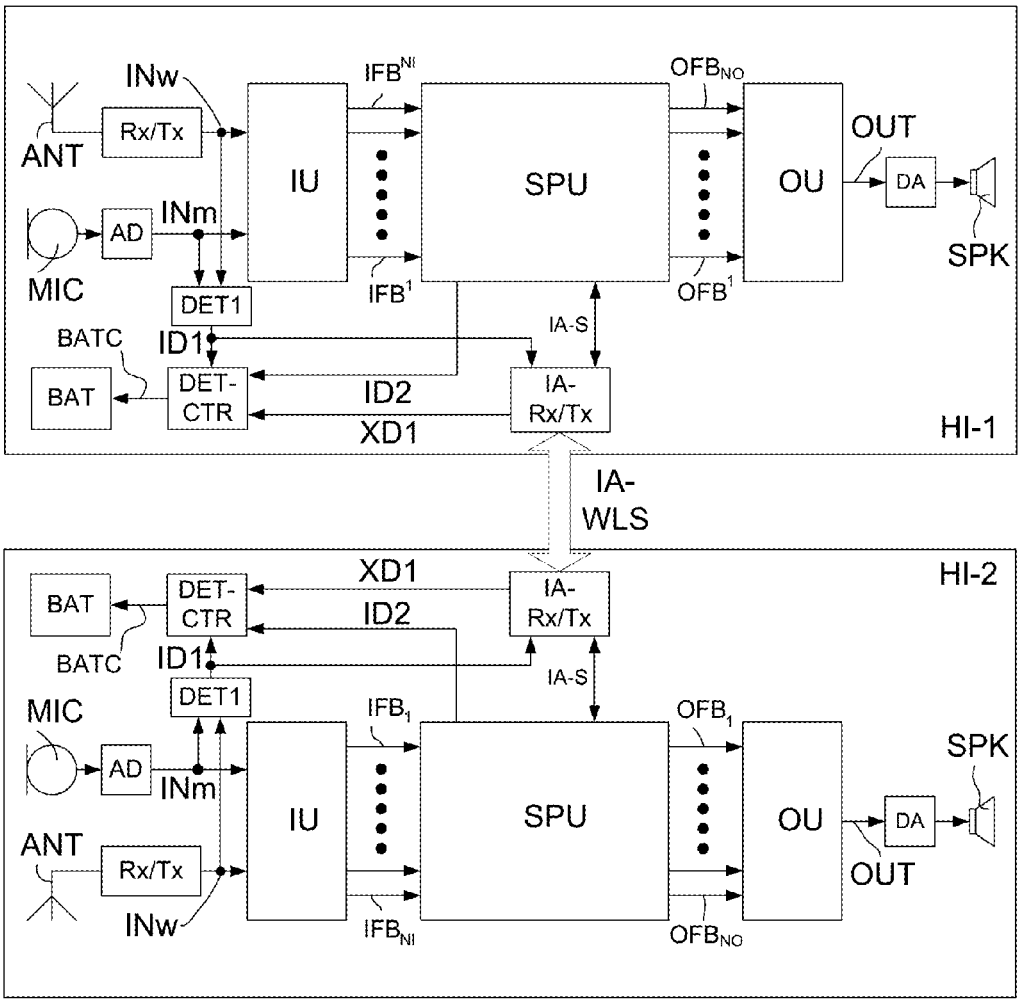
FIG. 3 shows an embodiment of a binaural hearing aid system comprising first and second hearing instruments.

FIG. 3 shows an embodiment of a binaural hearing aid system comprising first and second hearing instruments. The binaural hearing aid system comprises first and second hearing instruments (HI-1, HI-2) adapted for being located at or in left and right ears of a user.

The hearing instruments HI-1 and HI-2 each comprise a time to time-frequency conversion unit (IU) for converting time domain input signals INm and INw to time-frequency input signals $IFB_1$, $IFB_2$, . . . , $IFB_N$ allowing processing in the respective signal processing units (SPU) in a number of frequency channels $FB_1$, $FB_2$, . . . , $FB_N$. Each hearing instrument comprises a microphone unit comprising microphone (MIC) and analogue to digital conversion unit (AD) providing digitized input microphone signal INm, as well as a wireless transceiver comprising antenna (ANT) and transceiver circuitry (Rx/Tx) providing digitized input wireless signal INw. The input unit IU is configured to select one of the input signals INm or INw (or a mixture of them) and provide it as band split signal ($IFB_1$:$IFB_N$). The hearing instruments HI-1 and HI-2 each further comprise a time-frequency to time conversion unit (OU) for converting processed output signals $OFB_1$, $OFB_2$, . . . , $OFB_N$ to time domain signals OUT, which is fed to digital to analogue transformation unit DA and on to the output transducer, here a loudspeaker (SP).

The hearing instruments of FIG. 3 are further adapted for exchanging information between them via a wireless communication link, e.g. a specific inter-aural (IA) wireless link (IA-WLS). The inter-aural link may e.g. be based on inductive (near-field) communication, or alternatively on radiated field (far-field) communication. The two hearing instruments HI-1, HI-2 are adapted to allow the exchange of status signals, e.g. including the transmission of detector signals generated or received by an instrument at a particular ear to the instrument at the other ear. To establish the inter-aural link, each hearing instrument comprises antenna and transceiver circuitry (here indicated by block IA-Rx/Tx). Each hearing instrument HI-1 and HI-2 is an embodiment of a hearing assistance devise as described in the present application and may e.g. comprise some or all of the functional elements described in connection with FIG. 1. Each of the instruments HI-1 and HI-2 of the binaural hearing aid system of FIG. 3 comprises a control unit DET-CTR for—via control signal BATC—controlling the distribution of power from the battery BAT to various parts of the respective hearing instrument. The control unit DET-CTR receives control input signals ID1 from a first detector unit (DET1), and ID2 from the signal processing unit SPU both originating from the hearing instrument in question (e.g. HI-1) and a control signal input XD1 corresponding to ID1 generated by the first detector (DET1) from the other hearing instrument (e.g. HI-2) (and vice versa). The control signals ID1, XD1 from the local (ID1) and the opposite (XD1) device, respectively, are e.g. used together to influence a decision regarding entering a low-power mode in the local device (e.g. HI-1). In an embodiment, the hearing assistance system further comprises an auxiliary device for transmitting an audio signal to the hearing instruments. In an embodiment, the hearing assistance system is adapted to provide that a telephone input signal can be received in the hearing assistance device(s) via the auxiliary device or directly from the telephone. The first detector DET1 receives time domain input signals INm and INw and provides control input signal ID1. In an embodiment, control input signal ID1 is indicative of the acoustic environment (based on microphone input signal INm). In an embodiment, control input signal ID1 is indicative of the current reception of an audio signal (e.g. audio streaming). In an embodiment, control input signal ID1 is indicative of the hearing instrument being currently in operational use, if either an audio signal is being received by the wireless transceiver (signal INw comprises an audio signal) or if the microphone signal INm comprises a voiced signal (e.g. speech, e.g. comprising time segments having a modulation index above a certain threshold value). In an embodiment, the control input signals ID1 of the respective hearing instruments are compared, and if both comprise an audio signal (INw) or a voiced signal (INm), it is a good indication that the hearing instruments are in operational use (and that a low-power mode should not be entered). In an embodiment, control input signal ID2 generated in the signal processing unit is representative of at least one (optionally processed) signal of a particular frequency band, e.g. such frequency band comprising a tone (e.g. identified as a howl resulting from feedback). Such signal indicative of howl would—in the absence of an audio signal (INw) or a voiced signal (INm)—be indicative of the hearing instrument being in a non-operational state (e.g. located on a reflecting surface, e.g. a table, or in a storage box or other container or bag (without having its power turned off)). An appropriate action initiated by the control unit (DET-CTR) would be to ensure that the hearing instrument(s) would enter a low-power mode.

Figure 4:
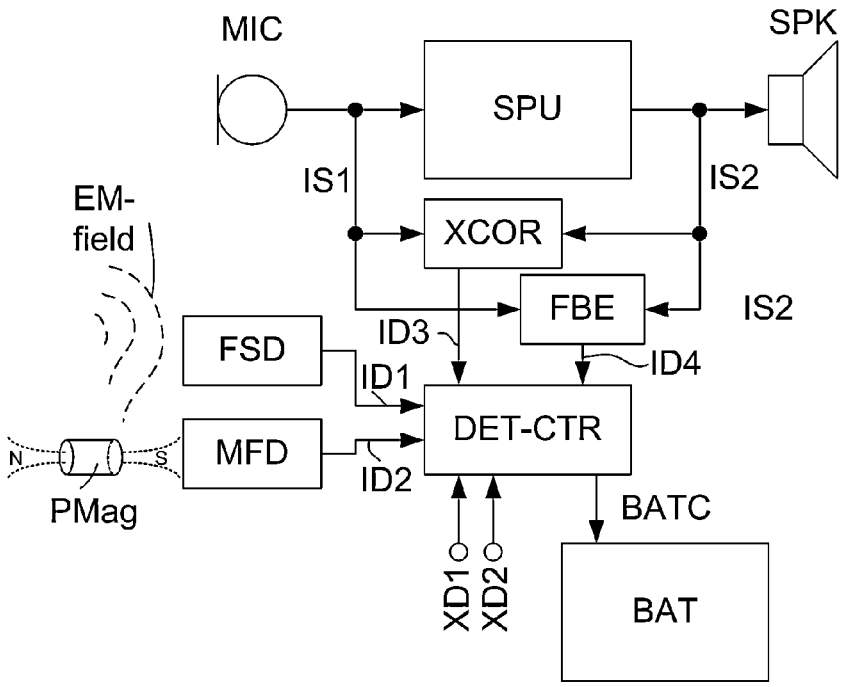
FIG. 4 shows a second embodiment of a hearing assistance device according to the present disclosure.

FIG. 4 shows a second embodiment of a hearing assistance device according to the present disclosure. The hearing assistance device of FIG. 4, e.g. a hearing aid, comprises a forward path from an input transducer (here a microphone) (MIC) via a signal processing unit (SPU) to an output transducer (here a loudspeaker) (SPK). The signal processing unit (SPU) may e.g. be configured to apply a (time) and frequency dependent gain to the electric input signal IS1 provided by the microphone (MIC) and to provide an enhanced output signal IS2 fed to the loudspeaker (SPK). The hearing assistance device further comprises a control unit (DET-CTR) receiving a number of control input signals ID1, ID2, ID3, ID4, XD1, and XD2 based on which a resulting control output signal BATC is generated and used to control the distribution of power to the hearing assistance device from a energy source (BAT), including the possible activation of a low-power mode of operation of the hearing assistance device. Control input signals ID1, ID2, ID3 and ID4 have their origin from detectors (FSD, MFD, XCOR and FBE) of the hearing assistance device itself, whereas control input signals XD1 and XD2, have their origin from detectors external to the hearing assistance device (e.g.

wirelessly received, from an auxiliary device, e.g. from the detector directly or from or via a remote control of the hearing assistance device, e.g. a Smartphone). Control input signal ID1 is generated by a detector (FSD) of the strength of a (possibly varying) electromagnetic field. Such signal can e.g. indicate whether or not the hearing assistance device is in an environment comprising significant amounts of electromagnetic signals, such significant amounts being for example (but not necessarily) due to the close presence of a telephone apparatus or of a contra-lateral hearing assistance device of a binaural hearing assistance system (e.g. a binaural hearing aid system), the two situations being possibly differentiated by different threshold field strengths. No or small amounts may indicate that a possible partner device (or other communication devices producing electromagnetic interference) is not present or powered down. Control input signal ID2 is generated by a detector (MFD) of the strength of a static magnetic field. Such signal can e.g. indicate whether or not the hearing assistance device is located in proximity to a permanent magnet, e.g. located in a telephone apparatus and indicating a telephone mode (implying no activation of a low-power mode) or e.g. located in a storage box, indicating a non-operational state (implying activation of a low-power mode). Control input signal ID3 is generated by a detector (XCOR) of correlation (e.g. the cross-correlation) of two signals IS1, IS2 of (here before and after the signal processing unit) the forward path of the hearing assistance device. Such signal can e.g. indicate a quality of a current feedback estimate (and thus contribute to an appropriate weight of a feedback estimate to a decision concerning entering a low-power mode of operation in a given situation). Control input signal ID4 is generated by a detector (FBE) for estimating a feedback path from the output transducer (SPK) to the input transducer (MIC). A large value of the feedback path at certain frequencies may indicate that the hearing assistance device is removed from its operational position at the ear and e.g. located at a table or in a storage box (or held in a hand) (implying activation of a low-power mode). Otherwise it may indicate a 'true' feedback situation during operation, e.g. resting an ear with the hearing assistance device at a pillow, putting on a hat, putting a hand to the hearing assistance device, hugging a person, etc. (implying no activation of a low-power mode). Such situations may be possibly be differentiated by comparing a currently measured feedback path with different stored typical frequency dependent feedback paths (cf. e.g. FIG. 6*c*) and/or with the aid of additional control input signals from other detectors (cf. e.g. FIG. 1 and description thereof). Control input signals XD1 and XD2 (e.g. wirelessly) received from external devices may e.g. include an external temperature, a location information, or other information signal (e.g. from a remote control, a telephone, or a contra-lateral hearing assistance device of a binaural hearing assistance system).

Figure 5:
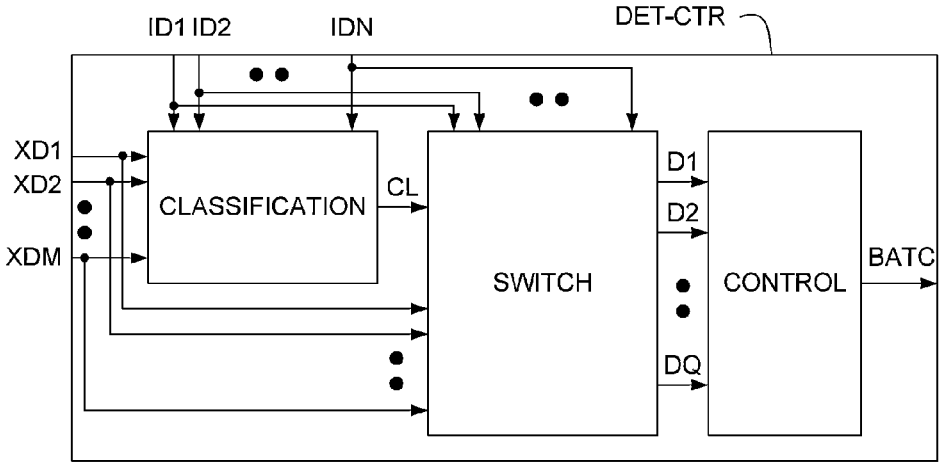
FIG. 5 shows an embodiment of a control unit for a hearing assistance device according to the present disclosure.

FIG. 5 shows an embodiment of a control unit for a hearing assistance device according to the present disclosure. The control unit (DET-CTR) comprises a classification unit (CLASSIFICATION) configured to classify the current situation based on a multitude of control input signals ($ID_1$, $ID_2$, . . . , $ID_N$ from internal detectors and $XD_1$, $XD_2$, . . . , $XD_M$ from external detectors). The classification unit is configured to provide that the control input signals that—in a given 'current situation'—are used as the two or more control input signals ($D_1$, $D_2$, . . . , $D_Q$) to the part of the control unit (CONTROL) that decides on activation or deactivation of a low-power mode (via output signal BATC) are signals from detectors that represent parameters or properties that complement each other in the current situation. The classification unit (CLASSIFICATION) provides the control input signals ($D_1$, $D_2$, . . . , $D_Q$) to be used in a current situation by controlling a switch array (SWITCH) receiving all control input signals ($ID_1$, $ID_2$, . . . $ID_N$ and $XD_1$, $XD_2$, . . . , $XD_M$) and a control signal CL from the classification unit for individually setting the switches of the switch array. A scheme for selecting the control inputs ($D_1$, $D_2$, . . . , $D_Q$) in a given situation may depend on the current values of one or more of the control input signals ($ID_1$, $ID_2$, . . . , $ID_N$ and $XD_1$, $XD_2$, . . . , $XD_M$). Alternatively or additionally, the control inputs ($D_1$, $D_2$, . . . , $D_Q$) in a given situation may be configurable, e.g. by an audiologist in a fitting situation and/or by a user (cf. also FIG. 7), to thereby allow the hearing assistance device to be configured to the habits and wishes of the user in question (with a view to ensuring a safe criterion for deciding to enter a low-power mode of operation).

Figure 6A:
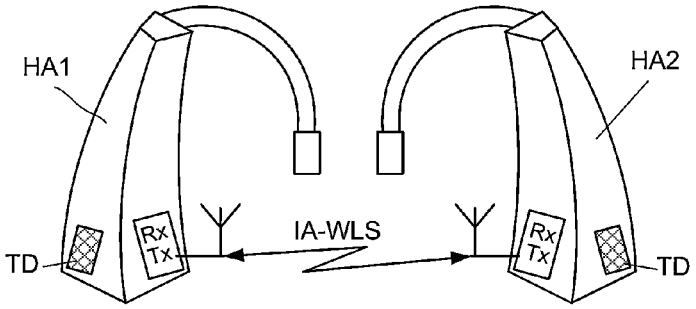
FIG. 6 shows first (FIG. 6*a*) and second (FIG. 6*b*) use scenarios for a binaural hearing assistance system according to the present disclosure and examples of feedback path gains for three different situations (FIG. 6*c*)
Figure 6B:
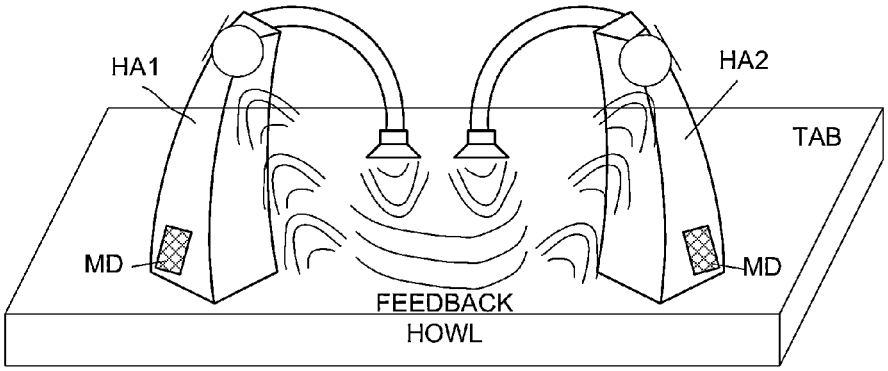
Figure 6C:
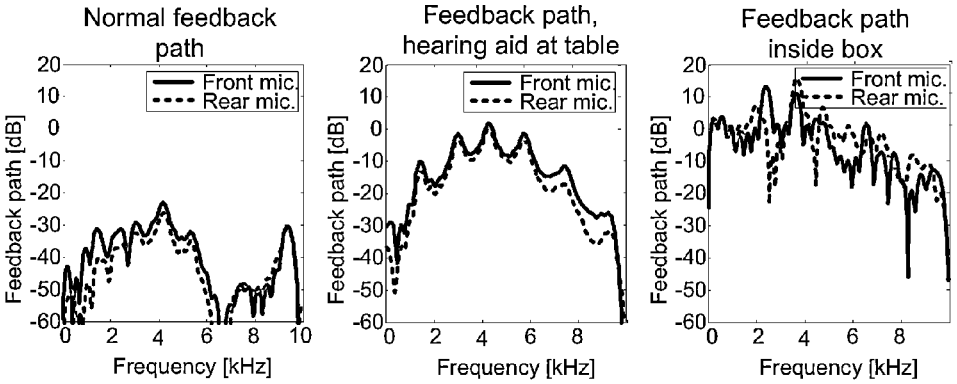

FIG. 6 shows first (FIG. 6*a*) and second (FIG. 6*b*) use scenarios for a binaural hearing assistance system according to the present disclosure and examples of feedback path gains for three different situations (FIG. 6*c*). The use scenarios of FIGS. 6*a* and 6*b* both illustrate a hearing assistance system (e.g. a binaural hearing aid system) comprising first and second hearing assistance devices (HA1, HA2) located in close vicinity of each other and assumed not to be located at the ears of a user, and not to be in a low-power mode. Each hearing assistance device (HA1, HA2) may be embodied in a hearing assistance device as described elsewhere in the present application (e.g. in FIG. 1, 3, 4). In the system of FIG. 6*a*, the hearing assistance devices (HA1, HA2) each comprise antenna and transceiver circuitry (Rx/Tx) configured to establish an inter-aural wireless link IA-WLS between the two hearing assistance devices (e.g. allowing an exchange of detector signals between the devices). Each hearing assistance device further comprises a temperature detector (TD) for sensing the temperature of the hearing assistance device (e.g. a skin temperature of the user, when the hearing assistance device in question is operationally mounted at an ear, or a temperature of the location of the hearing assistance device, when located elsewhere). A combination of a low temperature provided by the temperature detector (TD) and a high level of the received signal (either indicated by a field strength sensor or a saturated receiver or other measures) provided by monitoring the wireless transceiver (Rx/Tx) would indicate that the two hearing assistance devices are located close to each other and thus not worn. Based thereon a relatively safe decision to enter a low-power mode of operation for both hearing assistance devices can be made. In the scenario of FIG. 6*b*, the hearing assistance devices (HA1, HA2) are located on a reflecting surface (e.g. a table) TAB. Each hearing assistance device comprises a feedback detector for detecting a tone (or tones) due to a feedback signal (FEEDBACK HOWL) (and/or for estimating a feedback path) from the loudspeaker to the microphone of a given hearing assistance device. Each hearing assistance device further comprises a movement detector (MD) (e.g. an acceleration detector) for detecting a movement of the hearing assistance device in question. A combination of a detected howl from the feedback detector and a 'no movement' (or STILL, cf. FIG. 1*b*) detection from the movement detector (MD) would indicate that the two hearing assistance devices are not moved and located on a reflecting surface (thus implying a 'not being worn' situation). Based thereon a relatively safe decision to enter a low-power mode of operation for both hearing assistance devices can be made. The diagrams of FIG. 6*c* further illustrate the scenario of FIG. 6*b*. The graphs illustrate exemplary frequency dependent (0-10 kHz) feedback path gains (dB) for three different situations. For each situation, a feedback path from a loudspeaker to respective front (solid line) and rear (dotted line) microphones (e.g. located in a BTE part of the hearing assistance device) is shown. The left graph illustrates a normal feedback path where the hearing assistance device is located correctly at its operational position in a normal environment. The middle graph illustrates a feedback path where the hearing assistance device is located on a table (as in the scenario of FIG. 6*b*). The right graph illustrates a feedback path where the hearing assistance device is located in a storage box. The power estimate of the feedback increases from the 'normal' situation to the 'table' situation to the 'storage box' situation, as e.g. reflected in an appropriately chosen feedback measure (cf. e.g. 'P' below). The feedback estimate in a 'normal' situation has a dip at an intermediate frequency (in the example around 6.5 kHz), which is absent in the two other situations. The feedback path of the 'table' situation is clearly different from the 'storage box' situation at relatively low frequencies (below 2 kHz). The three feedback paths are thus clearly different, and a measured feedback path may be compared to such typical (stored) feedback paths and a 'most likely' situation identified by an appropriate comparison algorithm. The feedback path relating to a storage box is further peculiar in that it comprises frequency ranges with a gain larger than 1 (>0 dB). Offhand, one would believe such behavior to be impossible in a predominantly passive system, such as the acoustic feedback path. The occurrence may have its origin in reflections inside the cavity of the storage box that make the duration of the feedback path longer than the filter (e.g. a FIR filter) used to estimate the feedback path. If a longer filter were used for the feedback path estimation, we would most likely not see any parts of the feedback path having gains above 0 dB. With a view to identifying a feedback path relating to a 'storage box' (or 'table') situation, it is actually an advantage to have a (FIR) filter with a limited number of coefficients. If, however, a longer (FIR) filter is used, the estimated feedback path would contain energy at late reflections, which could be used to detect that the hearing aid was located inside a storage box. One feedback measure that may form a basis for such comparison is based on the power P of the feedback estimate FB, i.e.

$$P = \sum_n |FB(n)|^2$$

or alternatively a frequency weighted power estimate $$P = \sum_f w(f)|FB(f)|^2$$

where $|FB(n)|^2$ and $|FB(f)|^2$ are the squared absolute values of feedback gain at a particular time instant n and at a particular frequency f (and time), respectively, and w(f) is a frequency dependent weighting function. With reference to the feedback path graphs of FIG. 6*c*, the above power measure may e.g. be based on values $FB(f_i)$ at a number $N_f$ of frequencies $f_i$, i=1, 2, . . . , $N_f$, (e.g. at 0.5 kHz, 1 kHz, 2 kHz, 4 kHz, 6 kHz, 8 kHz), which are (repeatedly) stored in a memory of the hearing assistance device.

Figure 7:
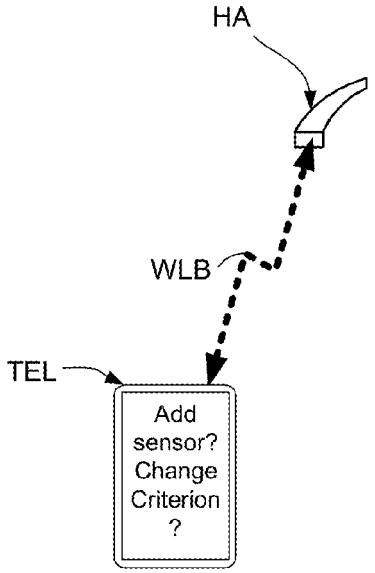
FIG. 7 shows an embodiment of a hearing assistance device with corresponding user interface in a remote control, here a Smartphone.

FIG. 7 shows an embodiment of a hearing assistance device with corresponding user interface in a remote control, here a Smartphone. FIG. 7 illustrates a hearing assistance device (HA) comprising a user interface, here in the form of a separate (auxiliary) remote control device, here integrated with a portable telephone apparatus (TEL), e.g. a Smartphone. The hearing assistance device of FIG. 7 can be any one of the embodiments described in the present application. The hearing assistance device and the Smartphone are configured to allow a user to control functionality of the hearing assistance device, including to enable (cf. entry 'Add sensor?' in the display of the Smartphone TEL) or disable a particular external sensor to contribute to the control input signals to the control unit of the hearing assistance device via the user interface. In the embodiment of FIG. 7, the hearing assistance device and the Smartphone are configured to allow a user to configure a particular sensor contributing to the control input signals to the control unit via the user interface, e.g. by setting threshold values for entering a low-power mode (cf. entry 'Change Criterion?' in the display of the Smartphone TEL). In an embodiment, the sensors that are allowed to be added (and/or configured) to or removed from contributing inputs to the decision of entering (or leaving) a low-power mode of operation by a user are selected from a predefined list of sensors appearing on the user interface.

Figure 8:
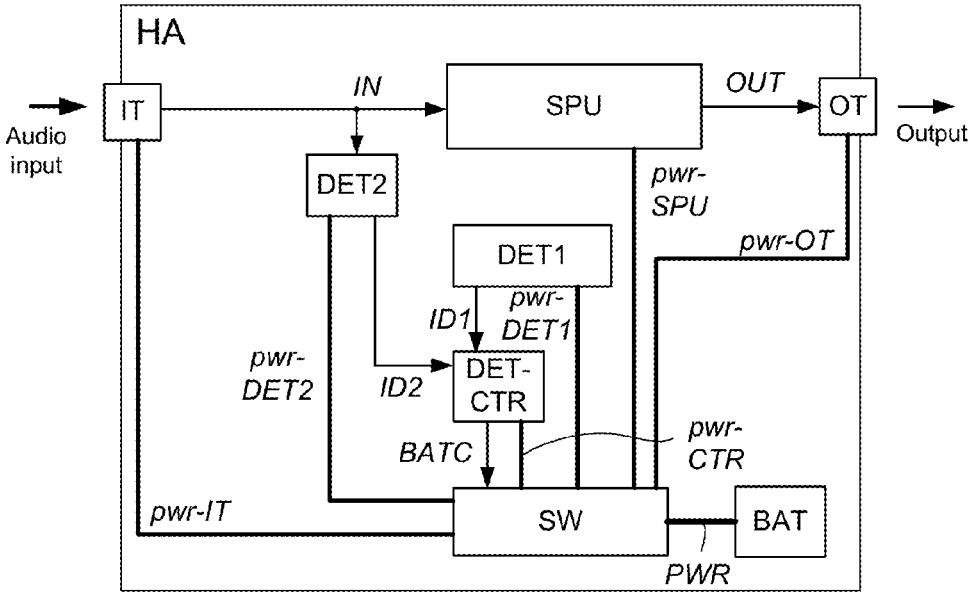
FIG. 8 shows an embodiment of a hearing assistance device according to the present disclosure wherein the power distribution is schematically illustrated.

FIG. 8 shows an embodiment of a hearing assistance device according to the present disclosure wherein the power distribution is schematically illustrated. The hearing assistance device of FIG. 8 can be any one of the embodiments described in the present application, and resembles the embodiment of FIG. 1. A difference is that the embodiment of a hearing assistance device of FIG. 8 only shows detectors DET1 and DET2, whereas DET3 and DET4 (feedback estimation unit FBE) are not included (not shown). Microphone (MIC) and loudspeaker (SPK) of FIG. 1 *b* are illustrated as input transducer (IT) and output transducer (OT), respectively, in FIG. 8. The external feedback path and the feedback cancellation system of FIG. 1*a* are not illustrated in FIG. 8. Instead, the separate power distribution to the functional blocks IT, OT, SPU, DET1, DET2, DET-CTR of the hearing assistance device is indicated. Separate conductors (pwr-IT, pwr-OT, pwr-SPU, pwr-DET1, pwr-DET2, pwr-CTR) supplying voltage and current (power) to respective functional blocks are connected to the energy source controlled by switch unit SW, which receives the supply voltage from the energy source (BAT, e.g. a battery) via conductor PWR. The switch unit (SW) comprises one or more switches (e.g. transistors) controlled by control signal BATC from the control unit (DET-CTR), as e.g. discussed in connection with FIG. 1. The power supply conductors may be individually controlled or controlled in groups according to a predefined scheme (e.g. in dependence of the current combination of control input signals (ID1, ID2, . . . ) to the control unit (DET-CTR). In an embodiment, the control (DET-CTR) and switch (SW) units are configured to selectively switch off the power supply to the signal processing unit (SPU, or a (significant) part thereof), when a low-power mode is decided by the control-unit to be entered. In an embodiment, power to the switch unit (SW) is ON when the hearing assistance device is in a low-power mode. In an embodiment, power to the switch unit (SW) and the control unit (DET-CTR) is ON when the hearing assistance device is in a low-power mode. In an embodiment, power to one or more of the detectors (DET1, DET2, . . . ) is also ON when the hearing assistance device is in a low-power mode. In an embodiment, power to a smaller number of the detectors (DET1, DET2, . . . ) are ON when the hearing assistance device is in a low-power mode compared to when the hearing assistance device is in a normal mode of operation. In an embodiment, only one of the detectors (DET1, DET2, . . . ), e.g. a movement detector, receives power, when the hearing assistance device is in a low-power mode.

EXAMPLES

The general idea of letting a hearing assistance device, e.g. a hearing aid, automatically detect whether it needs to be ON or OFF (or in a low-power mode) solves the problem of avoiding having to manually switch it ON and OFF and to thereby minimize the manual handling of the hearing aid. In an 'OFF-state', the hearing aid is preferably not completely powered off. Instead, it is in a low-power mode where it is preferably running on ultra-low power and periodically (e.g. every second or every 10 seconds or once every 100 seconds) "snooping" or "polling" the relevant sensors. In an embodiment, relevant parts of the hearing assistance device are periodically powered ON (when in a low-power or OFF-mode), a relevant mode of operation is decided on and the relevant mode is activated. Alternatively the low-power mode could be a 'completely OFF' mode, which would require a manual power ON.

In the following some ideas of how to automate an ON/OFF activation by one detector signal (e.g. to leave a low-power mode) or by a combination of at least two detector signals (to enter a low-power mode) are mentioned, exemplified by a hearing aid device.

Temperature Sensor:

A temperature sensor in a part of a hearing aid in contact with the skin of a user (e.g. a receiver assembly (an ITE-part) or a BTE-part) would make it possible to detect whether or not the hearing aid is placed in or at the ear. If the temperature of the sensor reaches the temperature of the human body (typically around 37.5° C.), then the hearing aid is turned ON (if in a low-power mode). If, on the other hand, the temperature reaches a level well below the human body temperature (e.g. ≥5° C. below), indicating that the hearing aid is presently not worn, the hearing aid may enter a low-power mode (be powered down, preferably provided that another sensor confirms or indicates the same). If the hearing aid needs to be able to automatically power on when placed in the ear, the hearing aid cannot be completely powered down. It would need to 'snoop' the temperature level at predefined intervals in time, e.g. every 1 second or so (or at a frequency≥0.1 Hz).

Feedback Path Estimation Sensor:

Another way of detecting whether the hearing aid is placed in or at the ear of a user is to estimate the acoustic feedback path, i.e. the transfer function of the loudspeaker, the sound out through the vent and the microphone. This transfer function may be considerably different a) when the hearing aid is operationally placed in or at an ear of the user and b) when it is out of the ear, e.g. located at a table or in a storage container (cf. also FIG. 6*b*, 6*c* and the description thereof). In an example based on the observation of the current feedback path estimate, the control unit of the hearing aid can conclude or indicate "hearing aid not worn", if the feedback estimation sensor estimates a gain in the feedback path that is higher than a reference value that has been determined for the specific user. In general, a comparison of the current feedback path estimate with stored reference feedback paths provides a valuable indication of whether or not the hearing aid is located in an operational position.

Internal Range Sensor:

Usually when the hearing aids are taken off, they are kept close together (e.g. at a distance in the range of 1-5 cm), e.g. in a carry case, a storage box, a pouch, a charger station, in the pocket etc., and when they are placed in/on the ears they are separated by the head (e.g. at a distance larger than 10 cm, e.g. in the range of 14-24 cm). The detection of the current distance between the hearing aids can be achieved by using existing wireless technologies, e.g. by analyzing the signal strength of the internal wireless communication between the hearing aids. An indication of the current distance between the hearing aids of a binaural hearing aid system provides a valuable indication of whether or not the hearing aid is located in an operational position.

Skin Capacitance Sensor:

In an embodiment, the hearing aid comprises a skin capacitance sensor. Preferably, the hearing aid is configured to turn ON (leave a low-power mode), when the skin capacitance sensor indicates that it is in contact with skin. A capacitive sensor can be located either on the housing of a hearing aid BTE-part adapted for being located behind the ear of a user (sensing the skin behind the ear) or on the housing of an ITE-part adapted for being located in the ear canal (sensing the skin in the ear canal).

Figure 9:
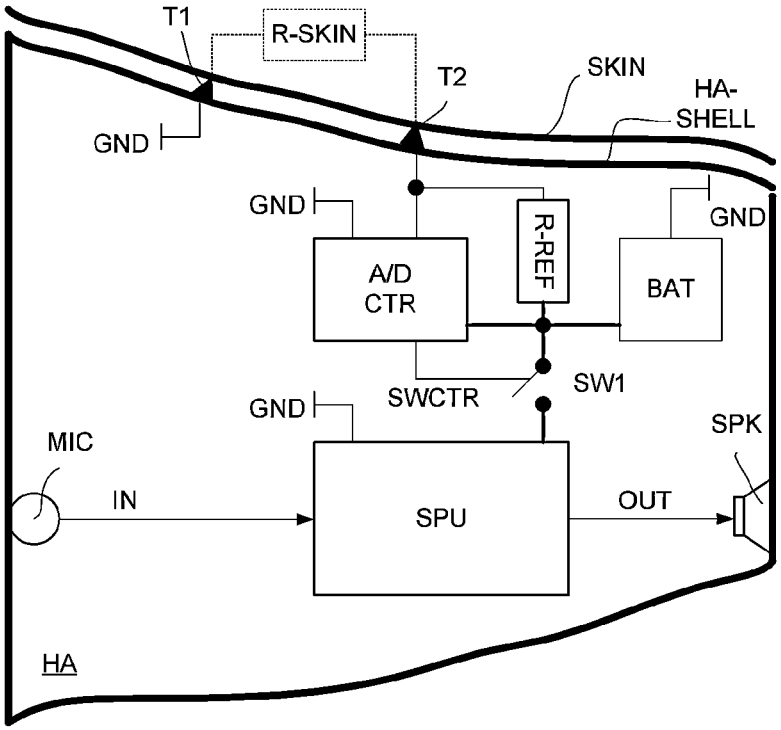
FIG. 9 shows an exemplary embodiment of a hearing assistance device comprising a skin resistance sensor and allowing a control unit to receive power in a low-power mode.

Skin Resistance Sensor:

In an embodiment, the hearing assistance device comprises a resistance sensor in the form of electronic circuitry capable of measuring electric resistance. A housing (or shell) of the hearing assistance device comprises two galvanic contacts where it contacts the skin of the wearer (e.g. behind the ear or in the ear canal) when properly mounted. The resistance sensor measures in regular intervals (e.g. every 10 s or every 100 s) the electric resistance across the two contacts. Depending on the measured resistance value, a resulting control input signal is generated indicating whether or not the hearing assistance device is presently being worn, and if not, a low-power mode can be preferably activated (controlled by the control unit). Two options occur: a) If we want no current consumption in low-power (OFF) mode, then the complete system needs to be powered down. This requires a manual reactivation to a normal mode of operation (ON). b) If a (low) 'standby power consumption' is permitted in the low-power mode, then the electronic circuit can continue monitoring the electric resistance across the galvanic contacts to detect re-mounting of the hearing assistance device (e.g. re-insertion or into the ear canal). In this case the control unit may automatically leave the low-power mode and switch to a normal mode of operation. Preferably, the hearing assistance device is adapted to use the two galvanic contacts for other purposes, e.g. as charging contacts for charging a rechargeable battery of the hearing assistance device. An exemplary embodiment of a hearing assistance device (HA) comprising a skin resistance sensor and allowing a control unit to receive power in a low-power mode is shown in FIG. 9. The hearing assistance device (HA) comprises a forward path from a microphone unit (MIC) to speaker unit (SPK). A signal IN from the microphone unit is processed in signal processing unit (SPU) of the forward path, and an enhanced signal OUT is forwarded to the speaker unit. The hearing assistance device (HA) comprises a housing (HA-SHELL) adapted for being located fully or partially in an ear canal of a user. The housing (HA-SHELL) comprises two electric contact terminals (T1, T2) adapted for contacting the skin (SKIN) of the user when the housing is operationally mounted. One terminal (T1) is connected to a reference potential (here ground GND). The other terminal (T2) is connected to an A/D converter and control unit (A/D CTR). The hearing assistance device (HA) further comprises a reference resistor (R-REF) connected with one terminal in series with the skin resistance (R-SKIN) and another terminal connected to a reference voltage (e.g. as here a voltage of the battery (BAT)). This measurement circuit allows a determination of the skin resistance, e.g. by a voltage division measurement, and thereby it can be estimated by the control unit (A/D CTR) whether or not the hearing assistance device is operationally mounted on the user. The switching of the hearing assistance device into a low-power mode (preferably based on at least one other sensor control input signal) can be performed by switch (SW1) controlled by signal SWCTR from the control unit. In a closed state of switch (SW1) (normal mode), the signal processing unit (SPU) receives power from the battery (BAT), whereas this is not the case when the switch is open (low-power mode). In this state (the low-power mode) the battery voltage is still supplied to the control unit (A/D CTR) allowing a continuous or regular monitoring of the skin resistance to verify whether the hearing assistance device is again operationally mounted on the user, in which case the low-power mode can be deactivated by closing switch SW1.

Skin Sensor Based on Light Emission/Detection

As an alternative to a capacitive or resistance based sensor to detect the proximity of human skin, a combination of a Light emitting diode (e.g. at infrared (IR) frequencies), and a photo diode/transistor or a Pyroelectrical InfraRed (PIR) sensor (a passive infrared sensor), can be used. Such sensors can be incorporated into the shell of the hearing assistance device. This has the following advantages: When the sensor detects that the hearing assistance device is removed from the ear, the control unit controls a switch that enables the low-power mode, in which only the most necessary blocks are still running (receive power). These preferably include at least the sensors that are used in order to detect when the hearing assistance device is reinserted/repositioned in/on the ear. In an embodiment, where the entire audio path is powered down in the low-power mode, a tone caused by feedback between the microphone and the receiver is avoided. When the hearing assistance device is reinserted/repositioned in/on the ear, the sensors will detect the change, and the hearing assistance device will power up again (leave the low-power mode and switch to a normal mode). Alternatively, a manually operable activation element (e.g. a push button) may provide the event responsible for powering up the hearing assistance device again.

Combinations of Sensors:

To reduce the risk of false detections, embodiments of the present disclosure comprise the following combinations of detectors or indicators:

In an embodiment, a "hearing aid not worn" conclusion is only made, if a temperature sensor indicates that the temperature has been dropping by predefined amount (e.g. more than 1° K) over a predefined time (e.g. during the last hour) AND if a force sensor on the left hand side of the hearing aid estimates a force that is less than half or more than double the force estimated by an equivalent force sensor on the right hand side of the hearing aid.

In an embodiment, the hearing aid comprises a GMR sensor and a voice activity detector. Simultaneous GMR detection and NO VOICE detection (both indicating a location of the hearing aids in a storage box comprising a permanent magnet) results in an activation of a low-power mode.

In an embodiment, each hearing aid of a binaural hearing aid system comprises a GMR sensor and comprises a wireless interface allowing the hearing aids to exchange signals (including sensor signals) between them. Simultaneous GMR detection on both hearing aids (indicating the location of both hearing aids in a storage box comprising a permanent magnet) results in an activation of a low-power mode in both devices.

In an embodiment, each hearing aid of a binaural hearing aid system comprises a feedback detection sensor. Substantially different feedback path detection (possibly combined with simultaneous GMR detection) results in an activation of a low-power mode.

In an embodiment, each hearing aid of a binaural hearing aid system comprises a field strength detector. Detection of a high signal strength between wirelessly connected hearing aids indicate that they are located close together (not in an operational position). This information can e.g. be combined with a simultaneous detection of a permanent magnet by a GMR sensor to result in an activation of a low-power mode.

Entering a Low-Power Mode:

Once the control unit has made a "hearing aid not worn" conclusion, it automatically operates a switch in the hearing aid (cf. switch unit SW in FIGS. 1*a* and 8) that powers down the hearing aid (or mutes it, or switches it to a low-power mode, etc.).

In an embodiment, a hearing aid comprises a multitude of sensors and/or the hearing aid can be configured to be in communication with external sensors and to receive relevant sensor signals (by wire or wirelessly). The multitude of sensors can for example contain at least one of the following 'sensors':

- Sensors using circuit access points in the hearing aid circuitry to monitor the signal processing of the hearing aid (e.g. of the forward path of the hearing aid), e.g. signal level, feedback, etc.
- Positive or Negative Temperature Coefficient (PTC or NTC) resistors for temperature surveillance.
- Photo diodes or photo transistors for light detection.
- GMR sensors for magnetic field detection.
- Electrodes for conductivity measurements on skin or other surfaces.
- Microphones for acoustic environment detection.
- Acceleration sensors for linear movement detection.
- Gyrators for radial movement detection.
- Force meter to measure the exchange of forces between the hearing aid and the skin of its user while the hearing aid is being worn, and the exchange of the hearing aid and its repository while it is not being worn.

Implementing a Low-Power Mode:

In the following, an integrated switch which can be used to implement a low-power mode in a hearing assistance device, such as a hearing aid, e.g. to turn off power to all parts of the device, is presented. In particular an integrated switch specifically adapted for using rechargeable batteries as a local source of energy is described.

A hearing assistance device using rechargeable batteries cannot be allowed to draw current from the battery indefinitely, because a too deep discharge can destroy some types of rechargeable battery, for example NiMH. The hearing assistance device must thus monitor the state of the rechargeable battery and decide when to stop drawing current from the battery, or at least reduce the current to insignificant levels.

In an embodiment, the power switch is implemented a MOS transistor switch, e.g. residing on one of the chips of the hearing assistance device. All power from the battery is routed through this switch, so no current can be drawn when the switch is off. In an embodiment, the switch is turned on by a user input (e.g. pushing a button or otherwise activating the power switch) or electronically (by asserting a control signal, e.g. via a remote control). Subsequently, the hearing aid steps through a wake-up procedure, as is state of the art if a normal (non-rechargeable, e.g. Zinc-Air) battery had been inserted into a traditional hearing assistance device.

After a period of normal use, the battery will slowly discharge to a given end-of-life level. In the case of NiMH batteries, this level is around 900 mV. At that point, no more current may be drawn from the battery without damaging it permanently.

This threshold crossing is preferably detected by a circuit on one of the chips of the hearing assistance device, and a predefined shut down procedure is initiated (e.g. controlled by the control unit, possibly taking into account other control input signals). Shut down is e.g. initiated by opening the switch (cutting off the current), stopping the draw on the battery. Thereby a storage of hearing assistance devices with rechargeable batteries for extended periods of time, without discharging, is enabled. This is a requirement for selling hearing assistance devices with rechargeable (e.g. NiMH or LiIon) batteries pre-installed in the hearing assistance device.

Figure 10:
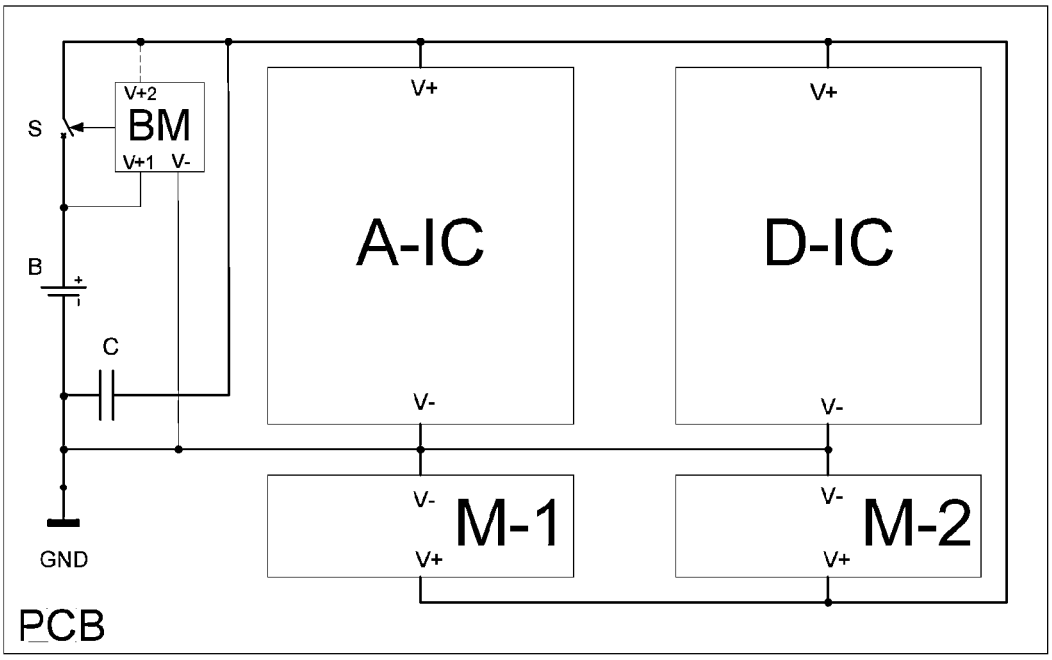
FIG. 10 shows switch which can be used to implement a low-power mode in a hearing assistance device, e.g. to turn off power to all parts of the device.

FIG. 10 shows a PCB for a portable hearing assistance device comprising a rechargeable battery B, e.g. a Li-Ion or a NiMH battery. The battery has a positive terminal V+ and a negative terminal V− connected to ground GND. The positive terminal is connected to a switch S whose state is controlled by a battery voltage monitoring circuit BM (and/or a control unit integrated there with to evaluate different sensor signals). The battery voltage monitoring circuit BM gets its input from the positive terminal of the battery voltage, either taken before the switch S (V+1) or after the switch (V+2), and from the negative terminal of the battery (V−). In the case, where the positive voltage input is taken after the switch (dashed connection to terminal V+2 on the BM circuit) the power supply to the a battery voltage monitoring circuit is off when the switch is open (requiring a manual power-up (manually closing the switch S by a user-operable activation element on the portable hearing assistance device)). In this configuration, the battery voltage monitoring circuit BM (and control unit) may be used to implement an automatic activation of a low-power mode (e.g. a power down) when the measured voltage is below a threshold voltage Vpd (or when the control unit decides so based on the at least two control input signals). When the positive voltage input is taken before the switch (input V+1 on the BM circuit), the battery voltage monitoring circuit BM (and a control unit and possible sensors integrated there with) is always connected to the battery and may additionally be used to implement an automatic deactivation of the low-power mode, e.g. a power up) when the measured voltage is above a predefined threshold voltage Vpu (and/or when the control unit decides to do so). A capacitor C is connected in parallel over the battery to stabilize the voltage. The positive and negative (GND) voltages are distributed to corresponding terminals V+ and V−, respectively, on various components on the PCB, here an analogue IC (A-IC), a digital IC (D-IC) and two electronic modules (M-1 and M-2), e.g. sensors, transducers, tele-coil circuitry, etc., are shown.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

The invention claimed is:

1. A hearing assistance system including a portable hearing assistance device, the portable hearing assistance device comprising:

an input unit for providing an electric input signal comprising an audio signal;

an output unit for providing on output signal originating from the audio signal;

a forward path between the input unit and the output unit;

an energy source for energizing components of the hearing assistance device;

wherein when a low-power mode of operation of the hearing assistance device is activated the draw of current from said energy source is reduced compared to a normal mode of operation of the device, the activation being influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein a deactivation of the low-power mode is also controlled, and the number of control input signals used to decide on a deactivation of the low-power mode is smaller than the number of control input signals used to activate the low-power mode.

2. The hearing assistance system according to claim 1, wherein one or more of said control input signals is/are received from another device.

3. The hearing assistance system according to claim 1, wherein said at least two different control input signals are selected from at least two different of said types of signals 1), 2), 3) or 4).

4. The hearing assistance system according to claim 1, wherein the at least two control input signals are dynamically selected, among a larger number of control input signals, that influence the decision on activation of a low-power mode at a given point in time depending on the classification of the current situation.

5. The hearing assistance system according to claim 1, wherein at least one of the control input signals for deciding on a deactivation of the low-power mode is different from the control input signals used to decide on an activation of the low-power mode.

6. The hearing assistance system according to claim 1, wherein deactivation of the low-power mode with a predefined time period after a condition for leaving the low-power mode has been fulfilled.

7. A hearing assistance system according to claim 1, wherein the hearing assistance system comprises a hearing aid.

8. A hearing assistance system including a portable hearing assistance device, the portable assistance device comprising:

an input unit for providing an electric input signal comprising an audio signal;

an output unit for providing on output signal originating from the audio signal;

a forward path between the input unit and the output unit;

an energy source for energizing components of the hearing assistance device;

wherein when a low-power mode of operation of the hearing assistance device is activated the draw of current from said energy source is reduced compared to a normal mode of operation of the device, the activation being influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein the hearing assistance system comprises a user operable activation element configured to allow deactivation of the low-power mode.

9. The hearing assistance system according to claim 8, configured to provide that an automatic decision to enter the low-power mode is disabled for a predefined time after an operation of the manual activation element to deactivate the low-power mode has been performed.

10. A hearing assistance system according to claim 8, wherein the hearing assistance system comprises a hearing aid.

11. A hearing assistance system including a portable hearing assistance device, the portable assistance device comprising:

an input unit for providing an electric input signal comprising an audio signal;

an output unit for providing on output signal originating from the audio signal;

a forward path between the input unit and the output unit;

an energy source for energizing components of the hearing assistance device;

wherein when a low-power mode of operation of the hearing assistance device is activated the draw of current from said energy source is reduced compared to a normal mode of operation of the device, the activation being influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, said hearing assistance system further including: an auxiliary device, the system being adapted to establish a communication link between the portable hearing assistance device and the auxiliary device to provide that information signals can be exchanged between or forwarded from one to the other.

12. The hearing assistance system according to claim 11, wherein the auxiliary device comprises an audio gateway device.

13. The hearing assistance system according to claim 11, wherein the auxiliary device comprises a user interface adapted to allow a user to add and/or configure a particular external sensor to provide a control input signal.

14. The hearing assistance system according to claim 11, wherein the auxiliary device comprises a user interface adapted to allow a user to deactivate a particular external sensor to provide a control input signal.

15. The hearing assistance system according to claim 11, wherein the auxiliary device comprises another hearing assistance device, and the two hearing assistance devices form part of a binaural hearing assistance system.

16. The hearing assistance system according to claim 15, wherein the two hearing assistance devices of the binaural hearing assistance system are adapted to exchange at least one of their respective corresponding control input signals, and to compare their respective corresponding control input signals, and to use the result thereof as an input to controlling the activation of said low-power mode of operation of the hearing assistance device.

17. A hearing assistance system according to claim 11, wherein the hearing assistance system comprises a hearing aid.

18. A hearing assistance system according to claim 11, wherein the auxiliary devices comprises a remote control device for controlling functionality and operation of the hearing assistance device, an audio delivery device, a telephone apparatus, or a PC or a combination thereof.

19. A method of providing a low-power mode in a portable hearing assistance device, the portable hearing assistance device comprising an input unit for providing an electric input signal comprising an audio signal, an output unit for providing an output signal originating from the audio signal, a forward path between the input unit and the output unit, and an energy source for energizing components of the hearing assistance device, the method comprising:

providing a low-power mode and a normal mode of operation of the hearing assistance device, wherein when said low-power mode is activated the draw of current from said energy source is reduced compared to a normal mode of operation of the hearing assistance device;

controlling the activation of said low-power mode of operation of the hearing assistance device by providing that the activation is influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein a deactivation of the low-power mode is also controlled by the controlling step, and the number of control input signals used by the controlling step to decide on a deactivation of the low-power mode is smaller than the number of control input signals used to activate the low-power mode.

20. A portable hearing assistance device comprising an input unit for providing an electric input signal comprising an audio signal, an output unit for providing on output signal originating from the audio signal, a forward path between the input unit and the output unit, an energy source for energizing components of the hearing assistance device, wherein, when a low-power mode of operation of the hearing assistance device is activated, the draw of current from said energy source is reduced compared to a normal mode of operation of the device, the activation being influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein the number of control input signals used to decide on a deactivation of the low-power mode is smaller than the number of control input signals used to activate the low-power mode.

21. A portable hearing assistance device according to claim 20 wherein deactivation of the low-power mode is controlled by a control input signal from a movement sensor.

22. A portable hearing assistance device according to claim 21 wherein one or more additional sensors providing one or more additional control input signals, which in a low-power mode is/are initially deactivated, is/are activated when a first control input signal indicates that a deactivation of the low-power mode should be initiated.

23. A method of providing a low-power mode in a portable hearing assistance device, the portable hearing assistance device comprising an input unit for providing an electric input signal comprising an audio signal, an output unit for providing an output signal originating from the audio signal, a forward path between the input unit and the output unit, and an energy source for energizing components of the hearing assistance device, the method comprising:

providing a low-power mode and a normal mode of operation of the hearing assistance device, wherein when said low-power mode is activated the draw of current from said energy source is reduced compared to a normal mode of operation of the hearing assistance device;

controlling the activation of said low-power mode of operation of the hearing assistance device by providing that the activation is influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein said method further comprises enabling deactivation of the low-power mode via a user operable activation element.

24. A method of providing a low-power mode in a portable hearing assistance device, the portable hearing assistance device comprising an input unit for providing an electric input signal comprising an audio signal, an output unit for providing an output signal originating from the audio signal, a forward path between the input unit and the output unit, and an energy source for energizing components of the hearing assistance device, the method comprising:

providing a low-power mode and a normal mode of operation of the hearing assistance device, wherein when said low-power mode is activated the draw of current from said energy source is reduced compared to a normal mode of operation of the hearing assistance device;

controlling the activation of said low-power mode of operation of the hearing assistance device by providing that the activation is influenced by a combination of at least two different control input signals, each control input signal being a signal selected from the group of signals comprising 1) signals relating to a current physical environment of the hearing assistance device, 2) signals relating to a current acoustic environment of the hearing assistance device, 3) signals relating to a current state of a wearer of the hearing assistance device, and 4) signals relating to a current state or mode of operation of the hearing assistance device and/or of another device in communication with the hearing assistance device, wherein said method further establishes a communication link between the portable hearing assistance device and an auxiliary device to provide that information signals can be exchanged between or forwarded from one to the other.

* * * * *